US008205657B2

(12) United States Patent
Bohlen

(10) Patent No.: US 8,205,657 B2
(45) Date of Patent: Jun. 26, 2012

(54) COVERING AND COMPONENT PARTS THEREOF

(75) Inventor: Jorg Bohlen, Langen (DE)

(73) Assignee: Hunter Douglas Industries BV, El Rotterdam (NL)

( * ) Notice: Subject to any disclaimer, the term of this patent is extended or adjusted under 35 U.S.C. 154(b) by 358 days.

(21) Appl. No.: 12/302,102

(22) PCT Filed: Jun. 8, 2007

(86) PCT No.: PCT/EP2007/005081

§ 371 (c)(1),
(2), (4) Date: Dec. 12, 2008

(87) PCT Pub. No.: WO2007/141031

PCT Pub. Date: Dec. 13, 2007

(65) Prior Publication Data

US 2009/0199977 A1 Aug. 13, 2009

(30) Foreign Application Priority Data

Jun. 9, 2006 (EP) ..... 06252982

(51) Int. Cl.
*A47H 1/00* (2006.01)

(52) U.S. Cl. ..... 160/29; 160/31; 160/245

(58) Field of Classification Search ..... 160/29, 160/30, 31, 243, 244, 245, 279, 313, 84.06, 160/191, 318

See application file for complete search history.

(56) References Cited

U.S. PATENT DOCUMENTS

| | | | | |
|---|---|---|---|---|
| 530,079 | A * | 12/1894 | Bergstresser et al. | 160/29 |
| 827,151 | A * | 7/1906 | Henderson | 160/245 |
| 878,410 | A * | 2/1908 | Meis | 160/245 |
| 1,084,051 | A * | 1/1914 | Wiggs | 160/302 |
| 1,464,412 | A * | 8/1923 | Dillon | 160/304.1 |
| 1,938,729 | A * | 12/1933 | Traut | 160/318 |
| 1,964,332 | A * | 6/1934 | Rembaum | 160/369 |
| 2,236,986 | A * | 4/1941 | Beeman et al. | 160/11 |
| 2,572,847 | A | 10/1951 | Ehret | |
| 4,202,395 | A | 5/1980 | Heck et al. | |
| 4,326,577 | A * | 4/1982 | Tse | 160/259 |
| 4,574,864 | A * | 3/1986 | Tse | 160/259 |
| 4,673,018 | A * | 6/1987 | Judkins | 160/84.06 |
| 5,005,000 | A * | 4/1991 | Riordan | 340/550 |
| 5,078,198 | A * | 1/1992 | Tedeschi | 160/315 |
| 5,437,298 | A * | 8/1995 | Lin | 135/117 |
| 5,535,806 | A * | 7/1996 | Kold et al. | 160/273.1 |
| 6,273,173 | B1 * | 8/2001 | Lassen | 160/84.06 |
| 6,338,378 | B1 * | 1/2002 | Kold | 160/279 |

(Continued)

FOREIGN PATENT DOCUMENTS

DE 198 07 541 C1 7/1999

(Continued)

*Primary Examiner* — David Purol

(74) *Attorney, Agent, or Firm* — Dorsey & Whitney LLP

(57) ABSTRACT

An architectural covering arrangement having two side rails for mounting in parallel either side of a window pane and at least one movable end rail for mounting perpendicular to the side rails and extending from one side rail to the other side rail, the side rails having on respective faces to be mounted on a window pane, a two-layer fastening structure with one of the layers adhered to the respective side rail and the other of the two layers to be adhered to the window pane, the two layers being freely attachable and detachable from one another.

25 Claims, 32 Drawing Sheets

U.S. PATENT DOCUMENTS

| | | | | |
|---|---|---|---|---|
| 6,598,653 | B1 * | 7/2003 | Gonzalez | 160/370.21 |
| 2005/0224190 | A1 | 10/2005 | Huang | |
| 2006/0289125 | A1 * | 12/2006 | Kollman et al. | 160/178.1 R |
| 2007/0089583 | A1 * | 4/2007 | Cheng | 83/455 |

FOREIGN PATENT DOCUMENTS

| | | | |
|---|---|---|---|
| FR | 861 816 | A | 2/1941 |
| FR | 2 656 370 | A1 | 6/1991 |
| WO | WO 96/29498 | A1 | 9/1996 |
| WO | WO 00/05478 | A1 | 2/2000 |

* cited by examiner

COVERING AND COMPONENT PARTS THEREOF

A wide range of coverings for architectural openings have been proposed in the past, including blinds to reduce or substantially eliminate light passing through the architectural opening, fly screens and the like. The arrangement of the covering material has been proposed in many different forms, for example a flat sheet which is rolled and unrolled from a roller, slatted or venetian-type blinds, pleated sheets which can be expanded and retracted and various multi-layer arrangements.

In general, the main blind body forming a fixed end rail is mounted above or to one side of the architectural opening. The covering extends from this main body to a secondary moving rail, which can be pulled away from the main body across the architectural opening such that the covering covers the architectural opening. Side guides may be provided along each side of the architectural opening perpendicular to the extent of the main body, but extending in the direction of deployment and retraction of the covering. The side guides can comprise a rigid structure of some sort or merely be formed by an arrangement of cords.

In general, coverings such as described above suffer from the problem that they are relatively difficult to mount. The main body is relatively large to accommodate the retracted covering material and any retraction springs. It is necessary to secure the main body firmly above the architectural opening. Also, assembly of the various components in situ can be somewhat complicated, requiring precise measurement and positioning of the various components.

It is an object of the present application to provide various features by which one or more of the above problems may be overcome or at least reduced.

According to the present invention, there is provided an end rail for a retractable roller covering, the end rail including a longitudinal housing, a roller within the housing mounted for rotation relative to the housing about a longitudinal axis such that a covering can be wound and unwound from the roller, a coil spring extending along the longitudinal axis between a first end and a second end, the first end of the coil spring being fixed rotationally relative to the housing and the second end of the coil spring being fixed rotationally relative to the roller, wherein when the roller is rotated to unwind a covering, the coil spring is unwound and provides a return torque to rewind the covering and at least one of the first and second ends are free to move axially such that, as the coil spring is unwound, the coil spring extends in length axially and substantially does not expand radially.

By allowing the coil spring to expand in its axial or longitudinal direction while it is tensioned during deployment of the covering, the usual diametric or radial expansion of previous covering coil springs is avoided. This allows a smaller-diameter roller and/or housing to be provided. As a result, a more compact end rail can be provided.

The end rail can be secured at one peripheral edge of an architectural opening or, since it can be provided in a compact or miniaturised form, can form a movable end rail which is moved across the architectural opening during deployment of the covering.

To enable further reduction in size, it is also proposed that the spring force of the coil spring is reduced in comparison with prior-art arrangements. In particular, it is proposed that the coil spring is arranged with a spring force sufficient only to turn the roller to retract the covering, for instance overcoming any frictional resistance. It is not necessary for the coil spring to retract the covering whilst overcoming the weight of the covering or any end rail on its opposite side. In this respect, the present invention also proposes an arrangement whereby other components secure the covering in one or more deployed or retracted positions. Hence, the coil spring need play no part in maintaining the position of the covering. A user or perhaps an automated mechanism can be relied upon to move the position of the ends of the covering, with the coil spring merely providing sufficient force to roll the covering around the roller within the end rail.

According to the present invention, there may be provided an architectural covering arrangement including two side rails for mounting in parallel respectively on either side of an architectural opening, two end rails for mounting in parallel to each other and perpendicular to the two side rails and a covering extending between the two end rails. At least one of the end rails includes a housing and a spring-biased roller rotatably mounted along a longitudinal axis, the covering being attached to the roller and the roller being spring-biased to roll the covering around the roller. The side rails are provided with an arrangement for supporting and maintaining one or both of the end rails at any position along the length of the side rails such that the spring bias of the roller need only be sufficient to overcome any frictional resistance to retraction of the covering and winding of the covering about the roller.

In this way, an end rail including the roller can be significantly reduced in size.

To maintain the movable end rail in position, the movable end rail can be provided, at each respective longitudinal end, with a guide for a cord, such as a throughhole. A cord extends from one longitudinal end of one side rail to the opposite longitudinal end of the other side rail, passing through the two guides of the movable end rail.

This provides, particularly as a result of a change in direction of the cord through the guides, frictional resistance to movement of the end rail along the two side rails.

To improve the arrangement, a second cord can similarly be extended from the first longitudinal end of the other side rail to the opposite longitudinal end of the first side rail, passing on its way along the movable end rail in an opposite direction to the first cord. Both cords could pass through the same guides of the movable end rail or the movable end rail could be provided with respective guides for the two cords.

Where more than one movable end rail is provided, respective cords can be provided for the respective movable end rails. Alternatively, it is possible for cords to be used in common between different movable end rails.

The cords may be secured to the ends of the side rails by means of springs.

Preferably, the ends of the movable end rails are arranged to co-operate with the shape of the side rails such that the ends of the end rails are guided by the side rails.

In particular, preferably, the movable end rails are held by the interaction between their ends with the side rails from moving away from the architectural opening.

Preferably, the two side rails are formed as channel sections facing each other across the architectural opening. The ends of the end rails can protrude into the channel sections such that the end rails are held from moving away from the architectural opening.

Also, the cords can be hidden from view by extending within the channel sections.

According to the present invention, there is provided an architectural opening covering assembly having two side rails for mounting in parallel on opposite respective sides of an architectural opening and at least one covering end rail to extend perpendicularly between the two side rails so as to be movable along the side rails, wherein a cord arrangement is provided which extends along the side rails and the movable end rail so as to secure the movable end rail at any position along the side rails in which it is placed, the cord arrangement also securing each end of the movable end rail to a respective side rail such that when the side rails and movable end rail are not attached adjacent to the architectural opening, the side rails and movable end rail remain secured together as a single assembly.

This allows convenient installation for a user, since assembly on site is not necessary.

Preferably, when the two side rails and moveable end rail are not attached to an architectural structure, the moveable end rail can be re-orientated relative to the two side rails so as to be substantially parallel to the two side rails.

In this way the overall size of the assembly can be reduced for storage or transport. The two side rails and moveable end rail can be brought together such that they are parallel and adjacent one another in a compact arrangement. Because the two side rails and moveable end rail remain secured together as a single assembly by means of the cord arrangement, it is easy for a user to re-orientate them ready for installation.

Where an additional moveable end rail is provided or a fixed end rail is provided, the additional moveable end rail or the fixed end rail could similarly be secured together with the two side rails by means of the cord arrangement and be moveable so as to be re-orientated to be parallel to the other rails.

Preferably, the assembly is provided with at least one packing clamp, which is arranged to hold the two side rails and at least the at least one moveable end rail with the two side rails and the at least one moveable end rail adjacent and parallel to one another.

This provides a convenient way of holding all of the components together for storage and/or transport.

Preferably, two packing clamps are provided. Each packing clamp may be slidable along the moveable end rail and engageable with a respective one of the two side rails when the moveable end rail extends perpendicular between the two side rails so as to substantially rigidly secure the at least one moveable end rail between the two side rails.

In this way, having arranged the two side rails at either end of the moveable end rail, the packing clamps can be used to secure the arrangement as a rigid structure. This rigid structure is ready for installation on an architectural opening and facilitates movement and installation of the structure.

Where an additional moveable end rail or a fixed rail is provided, preferably the packing clamps similarly slide along the additional moveable end rail or the fixed end rail while that additional moveable end rail or fixed end rail is held adjacent and parallel to the first-mentioned moveable end rail.

Preferably, the packing clamps are configured to spring-clip around part of the periphery of the moveable end rail such that, with the two side rails mounted on opposite respective sides of an architectural opening, the packing clamp can be disengaged from the moveable end rail.

In this way, having mounted the assembly to an architectural opening, the packing clamps can be slid inwardly so as to disengage from their respective side rails and then pulled away from the moveable end rail to leave the assembly ready for use. Where a second moveable end rail is provided, preferably the packing clamps similarly spring-clip around part of the periphery of the second moveable end rail.

Preferably, the assembly further includes a packing tube within which the two side rails and the moveable end rail may be stored when orientated parallel to one another.

Where packing clamps are provided, these preferably also fit within the packing tube whilst securing the various rails together.

Preferably, the cord arrangement includes a cord and the cord may have end portions which extend along each of two side rails and an intermediate portion extending through the moveable end rail.

In one embodiment, a cord extends from a first end of a first side rail along a length of that side rail, then extends through the moveable end rail to the opposite second side rail and then extends along a length of that opposite second side rail to a second end of that opposite side rail opposite to the first end of the first side rail from which it originated.

A second cord may be provided extending in a similar manner from the second side rail at its first end to the first side rail at its second end.

The cords are preferably provided under some tension.

Preferably, the assembly further includes a spring fixing an end of the cord to one of the two side rails, thereby allowing the cord to be pulled away from the two side rails by an amount limited by the resilience of the spring.

Where a second cord is provided, this may also have a spring at one end.

The spring or springs allow some movement between the moveable end rail and the side rails whilst they are still secured together as a single assembly. This movement may be sufficient to allow re-orientation of the rails as described above or enough merely to allow access to the side rails to provide adjustment of the cords as will be discussed below.

Preferably, the assembly further includes an adjust mechanism for adjustably securing an end of the cord to one of the two side rails, the adjust mechanism being selectively moveable between a first state in which excess cord length is provided between the moveable end rail and the two side rails and a second state in which the excess length is taken up.

This provides a convenient way of providing sufficient cord length to allow the re-orientation of the rails and packing as described above. Preferably, the adjust mechanism includes an adjuster which is slidable along the length of said one of the two side rails, said end of the cord being attached to the adjuster and the cord extending from the adjuster, through a portion at least proximate an end of said one of the two side rails and to the moveable end rail, wherein said first state is provided with the adjuster at least proximate said end of said one of the two side rails and said second state is provided with the adjuster away from said end of said one of the two side rails.

Hence, merely by sliding the adjuster along the length of the side rail, it is possible to take up the excess cord length provided for re-orientating the rails. In the second state, the cord length is reduced to a length appropriate to enable it to secure the moveable end rail at any position along the two side rails. A spring is preferably provided at the end of the cord and where this is used this helps retain the cord with an appropriate tension.

Preferably, the assembly further includes means for securing the adjuster in at least said first state.

A latch could be provided or a threaded member for tightening the adjuster to the respective rail.

Preferably, the assembly further includes a stopper which is provided along the length of said one of the two side rails and positioned to stop the adjuster at a position away from said end of said one of the two side rails at which the adjust mechanism is in said second state.

Particularly where the cord is provided with a spring to maintain it under tension, it may be difficult to ensure that the adjuster is positioned at the best possible position for the correct tension in the cord. By providing the stopper, a user can easily ensure that the adjuster is at the correct position for the second state.

As mentioned above, the assembly may include a second cord and a second adjust mechanism for adjustably securing an end of the second cord to the other of the two side rails. The adjust mechanism may be equivalent to the adjust mechanism discussed above.

Where a second moveable end rail is provided, third and/or fourth cords may be provided, together with third and/or fourth adjust mechanisms in the same way as described above.

The assembly may further be provided with a flexible covering member extendable from the moveable end rail.

The covering member may be a sheet of flexible material, a venetian blind or a pleated shade.

The moveable end rail may house a retraction mechanism for the covering member.

Preferably, the moveable end rail includes a roller for winding the sheet of flexible material and the roller may be spring-biased.

Preferably, the biasing spring of the roller has one of its ends slidably, but non-rotatably connected to a non-circular portion of a shaft.

This allows the spring to wind or unwind whilst changing in axial length and not changing in diameter.

A first edge of the sheet may be attached to the roller.

An opposite second edge of the sheet may be attached to a second moveable end rail or to a fixed end-rail affixed to corresponding ends of the two side rails.

The opposite second edge of the sheet may be attached to a further roller provided within either the fixed end rail or the second moveable end rail.

The side rails may include respective guide tracks for guiding movement of the moveable end rail. The moveable end rail may have a constant cross-section along its length and end members on its opposite longitudinal ends.

According to the present invention, there is also provided an architectural covering arrangement having two side rails for mounting in parallel either side of a window pane and at least one movable end rail for mounting perpendicular to the side rails and extending from one side rail to the other side rail, the side rails having on respective faces to be mounted on a window pane, a two-layer fastening structure with one of the layers adhered to the respective side rail and the other of the two layers to be adhered to the window pane, the two layers being freely attachable and detachable from one another.

The two-layers are preferably hook-and-loop fasteners, for instance Velcro (trade mark).

In this way, for each of the side rails, one of the two layers can easily be positioned and adhered to the edges of a window pane as required. Mounting of the covering assembly can then easily be achieved merely by positioning the side rails opposite the fastening layers attached to the window pane and pressing the two layers together. Indeed, if further adjustment is required or if maintenance to the covering assembly is required, the side rails can easily be pulled away from the window pane and reinstalled as required.

The fastening layers are provided on faces of the side rails parallel with the plane of the window pane to which they are to be attached so that the side rails are attached directly to the window pane.

This method of mounting a covering assembly to a window is particularly advantageous, because no invasive or destructive mounting to the window frame is necessary. This is particularly advantageous in double-glazing-type structures where the window frame may be important to the structure of the double glazing. Some prior-art arrangements have attempted to include mountings which are inserted between the window pane glass and the frame, but this can interfere with the sealing and structural integrity of the window.

By the nature of glass itself, it is possible to use adhesive for the fastener strips without damaging the structure of the glass. This makes it particularly advantageous to be able to mount the covering assembly directly to the glass, rather than its frame.

Where a fixed end rail is provided extending between the corresponding ends of the two side rails, a pair of fastening strips, such as hook-and-loop fasteners, are similarly used to attach the end rail to the window pane.

It will be appreciated that attaching side rails (and possibly an end rail) directly to the window pane, rather than its frame, would be somewhat counter-intuitive to the skilled person due to the inevitable reduction in open area of the window (due to the physical extent of the side rails and end rail).

By means of the features discussed above, end rails and side rails of significantly reduced extent can be provided. As a result, a highly advantageous covering assembly is provided by the present invention.

It is possible to provide a covering retraction roller in only one end rail. However, by providing such a roller at each of two opposite ends of the covering, it is possible to reduce the size of the end rail. Either way, one of the end rails can be fixed at corresponding ends of the side rails with the other end rail being movable along the side rails or, alternatively, both end rails can be movable along the side rails allowing increased flexibility of positioning of the covering over the architectural opening.

It is also possible to provide three or more end rails having respective coverings extending between adjacent end rails, the end rails being provided with retractable rollers as necessary. In this way, even with end rails of small size having limited capacity for storing rolled covering material, an architectural opening of large size may be covered by using a plurality of such end rails.

The present invention is particularly useful with certain pre-fabricated windows, such as factory-manufactured system windows. Pre-fabricated windows often have PCV frame members. They present critical conditions for mounting window coverings because (i) any mounting of a window covering holds a risk of interfering with the integrity of the window construction and might compromise warranty claims; and (ii) in particular PVC material in window frames may also lack sufficient structural integrity to allow the mounting of heavy structures. The present invention allows light-weight coverings to be provided and these to be attached to glass of the window.

The invention will be more clearly understood from the following description, given by way of example only, with reference to the accompanying drawings, in which.

Figure 1:
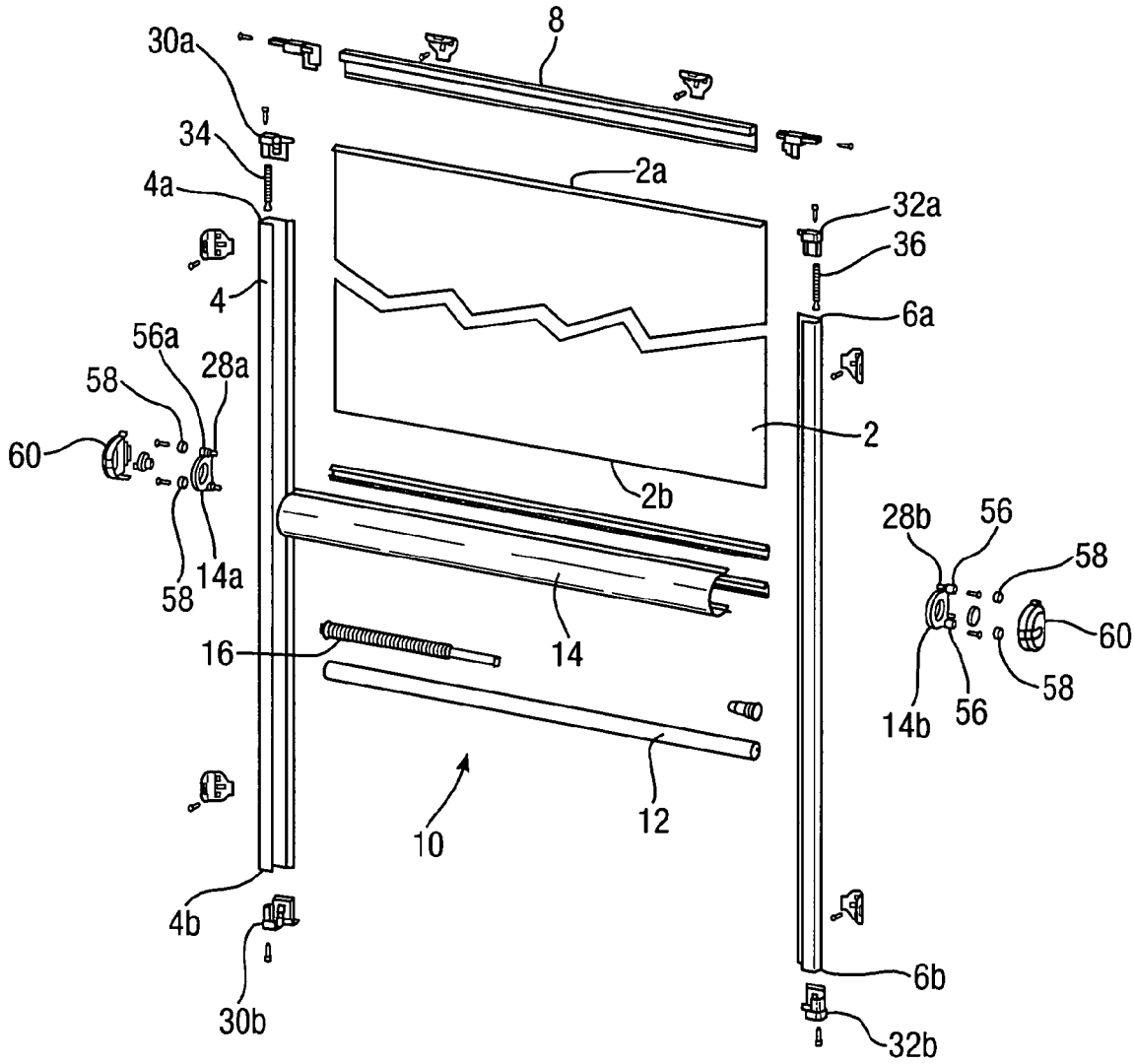
FIG. 1 illustrates a first embodiment of the present invention.
Figure 2:
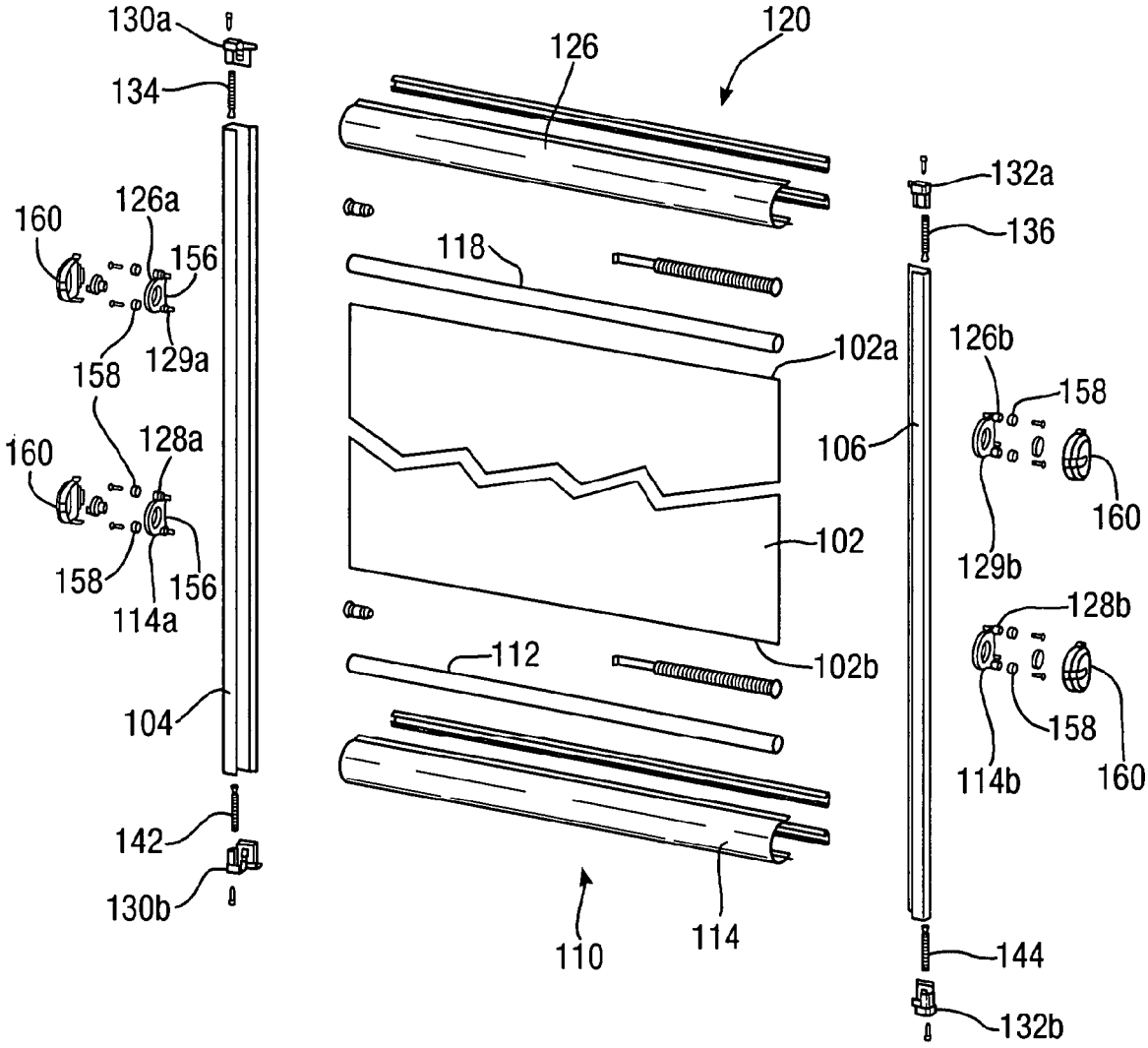
FIG. 2 illustrates a second embodiment of the present invention.
Figure 4A:
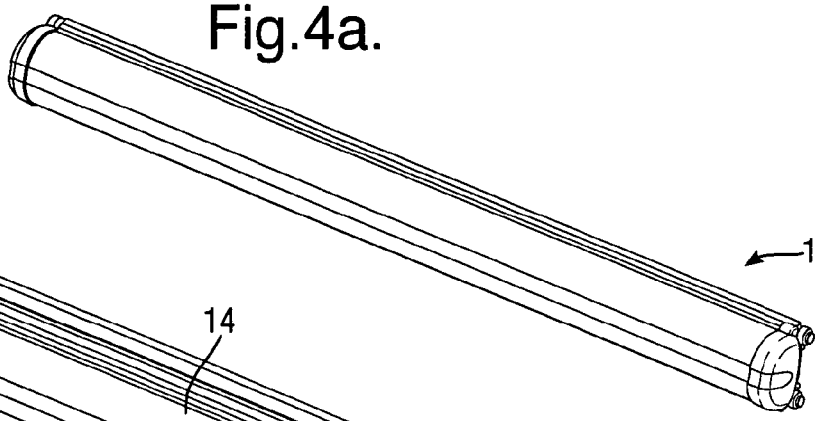
Figure 4B:
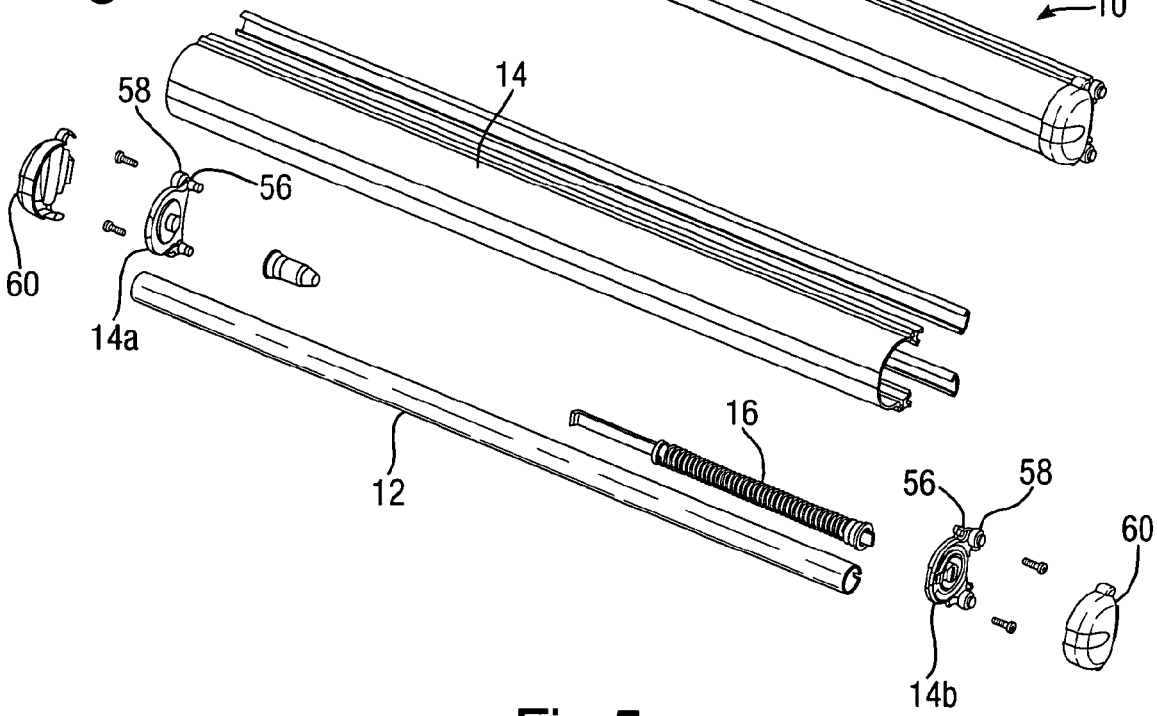
Figure 5:
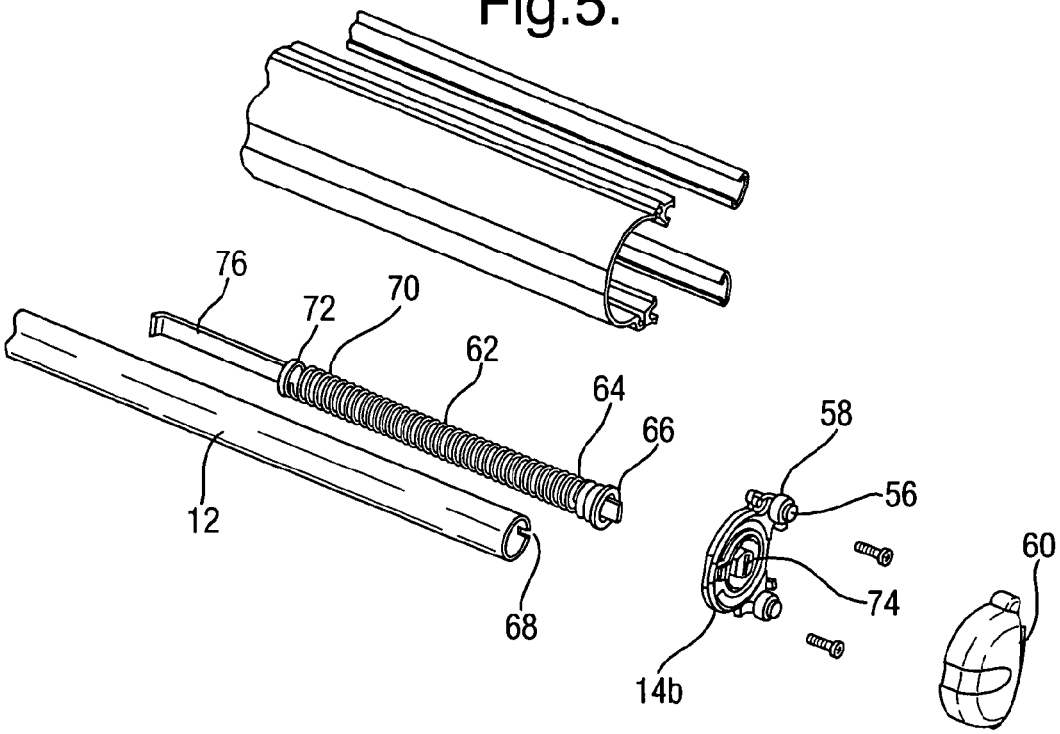
Figure 6:
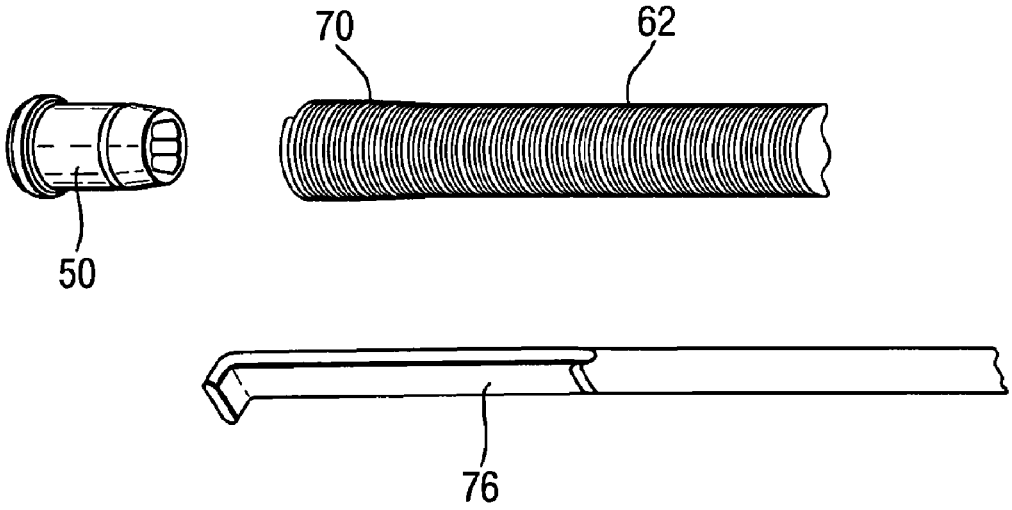
Figure 7:
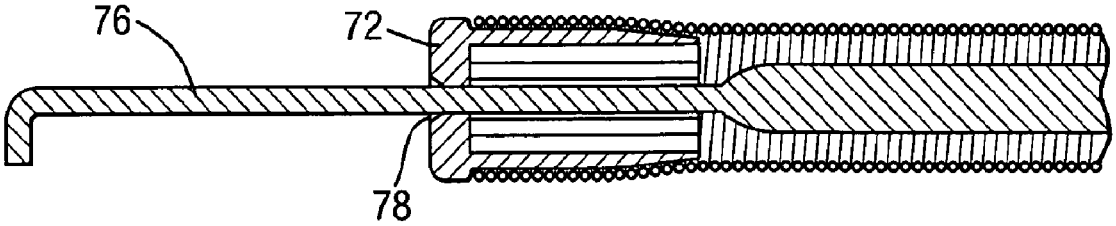
Figure 9:
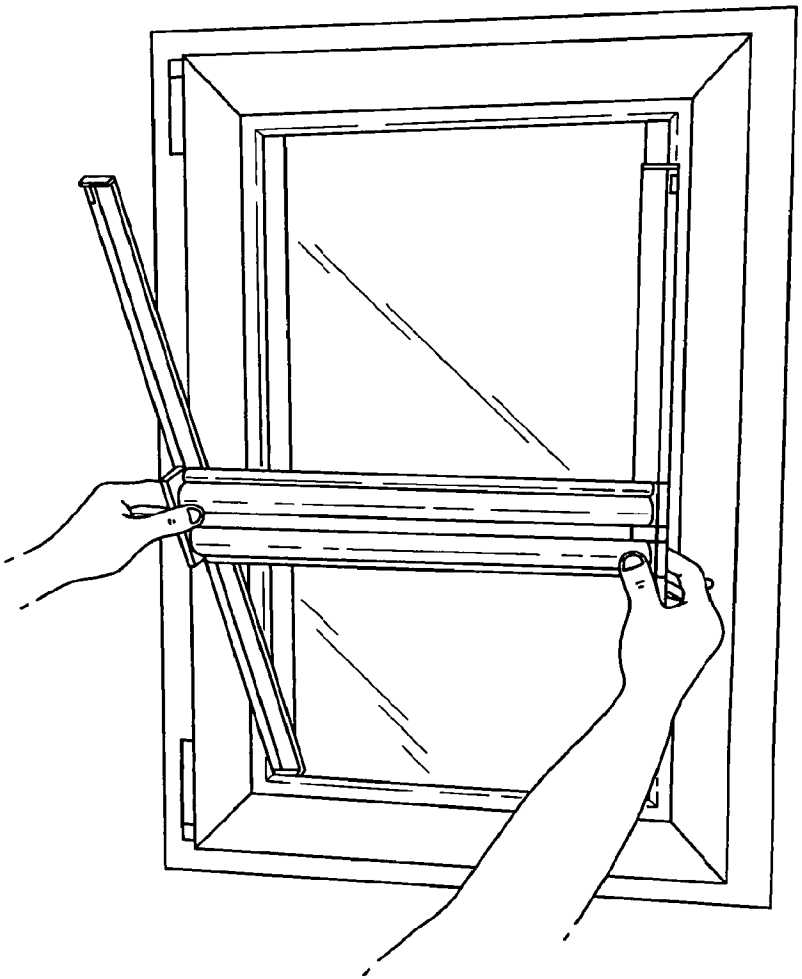
Figure 8:
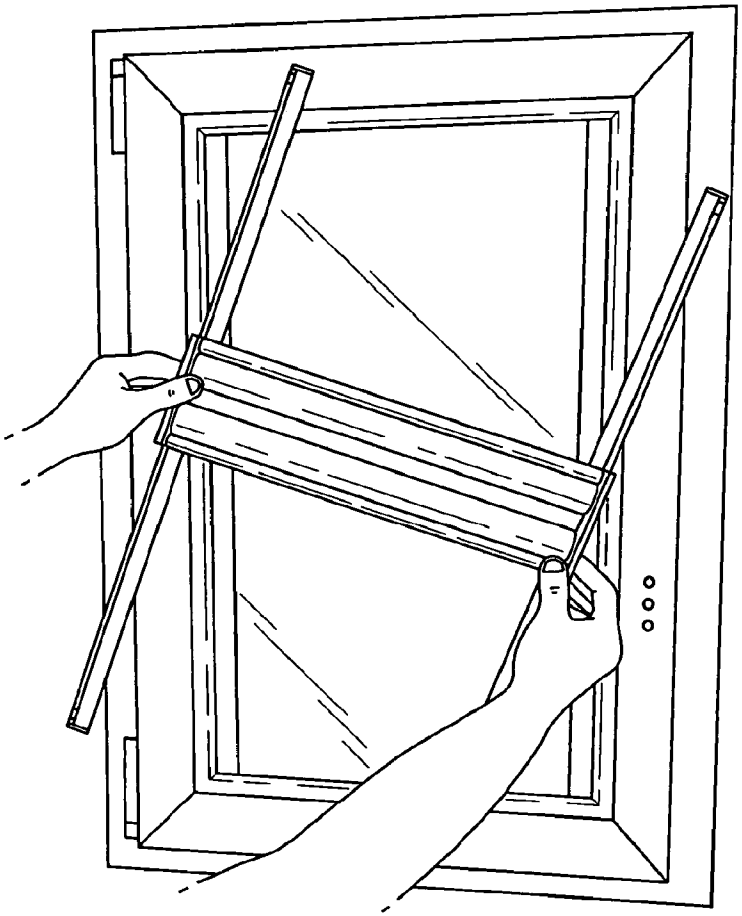
Figure 10:
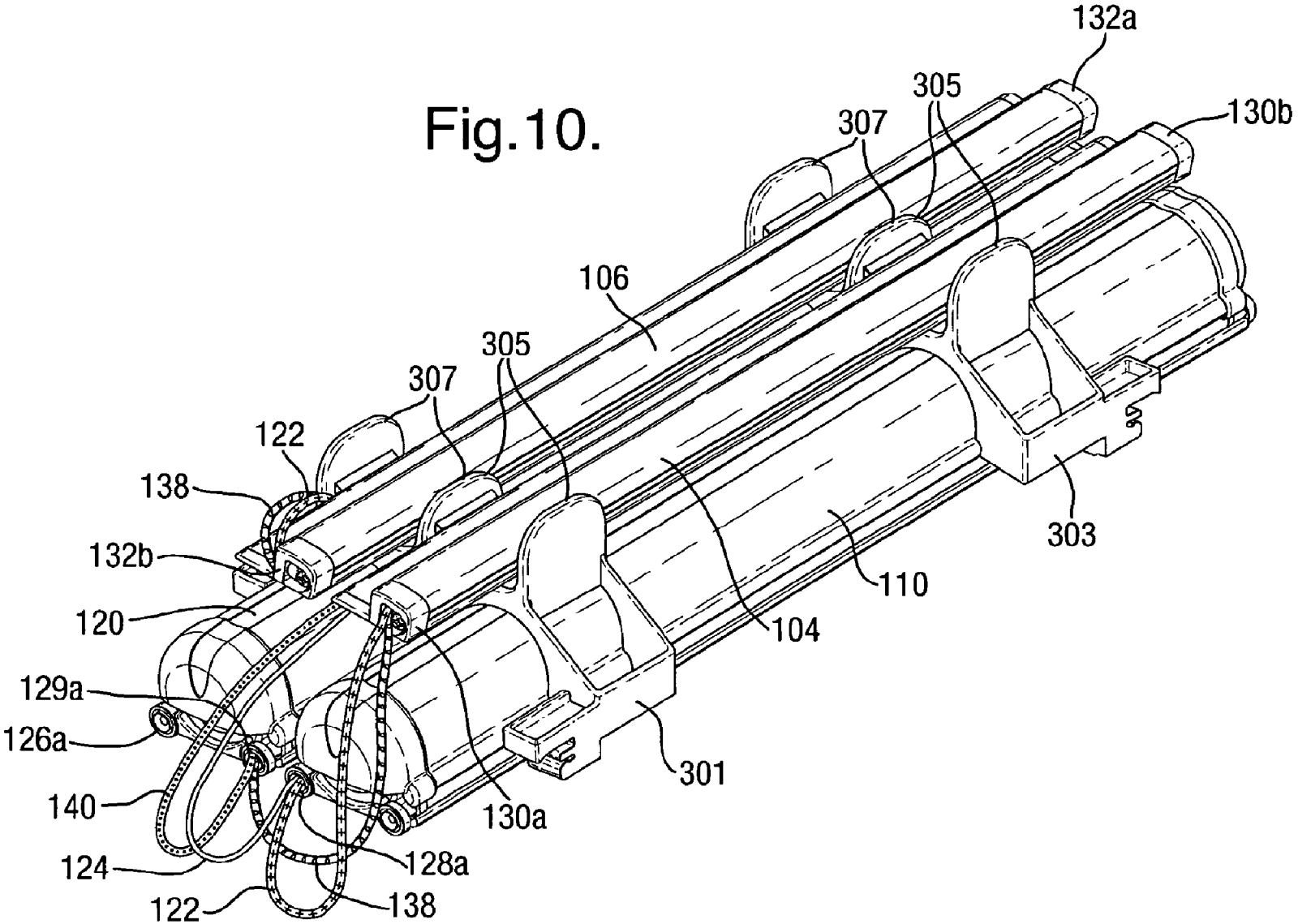
Figure 11A:
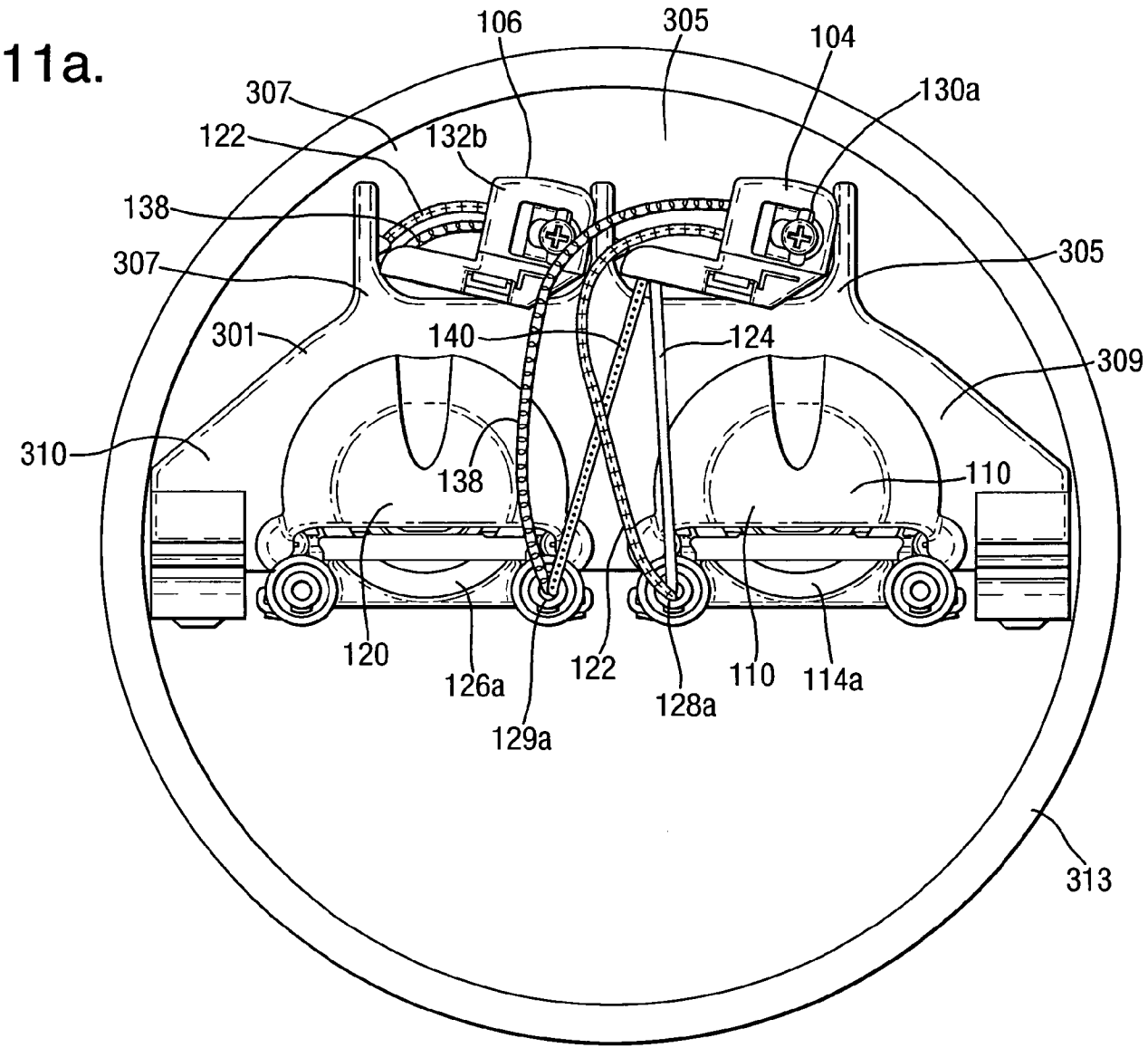
Figure 11B:
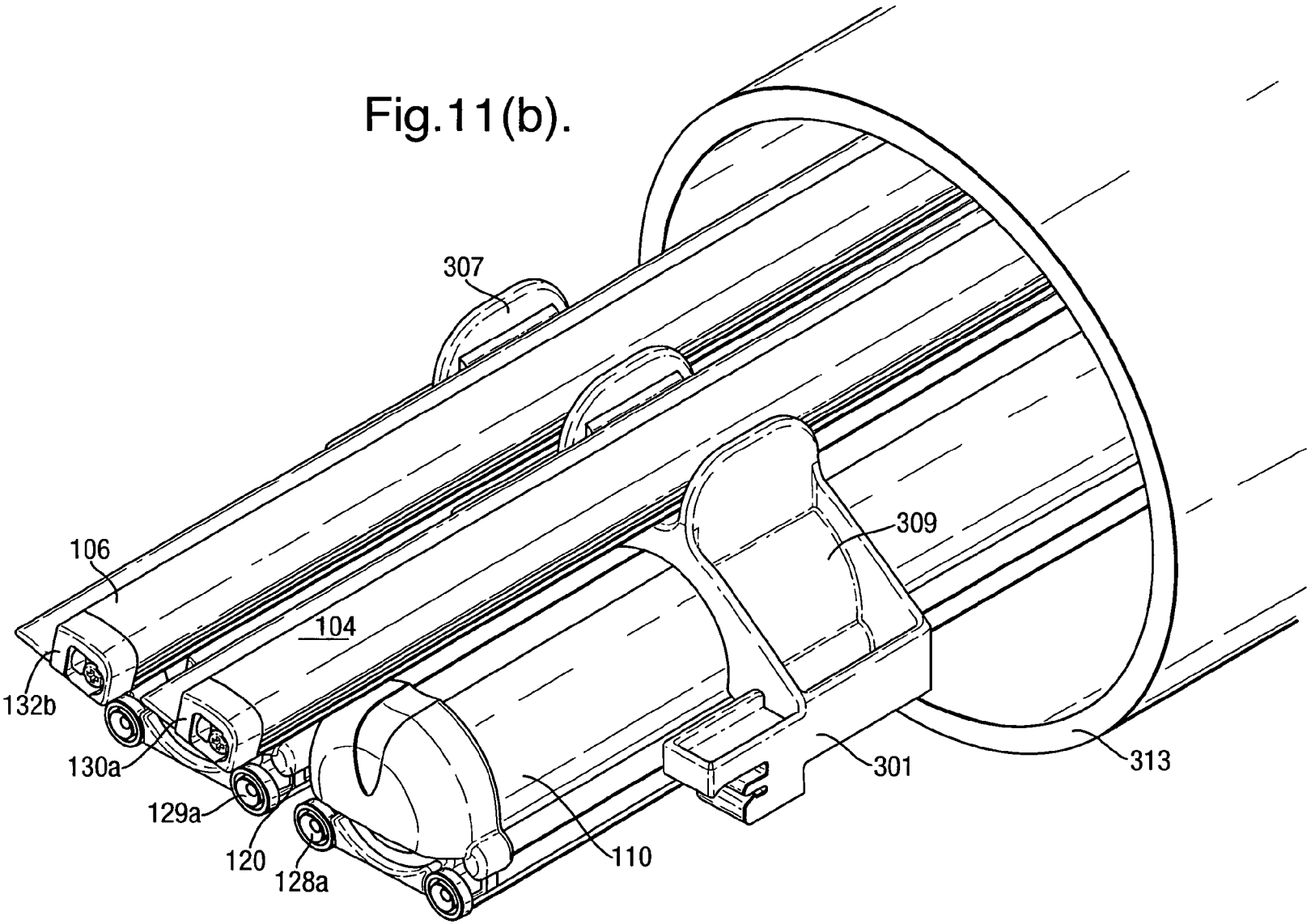
Figure 12:
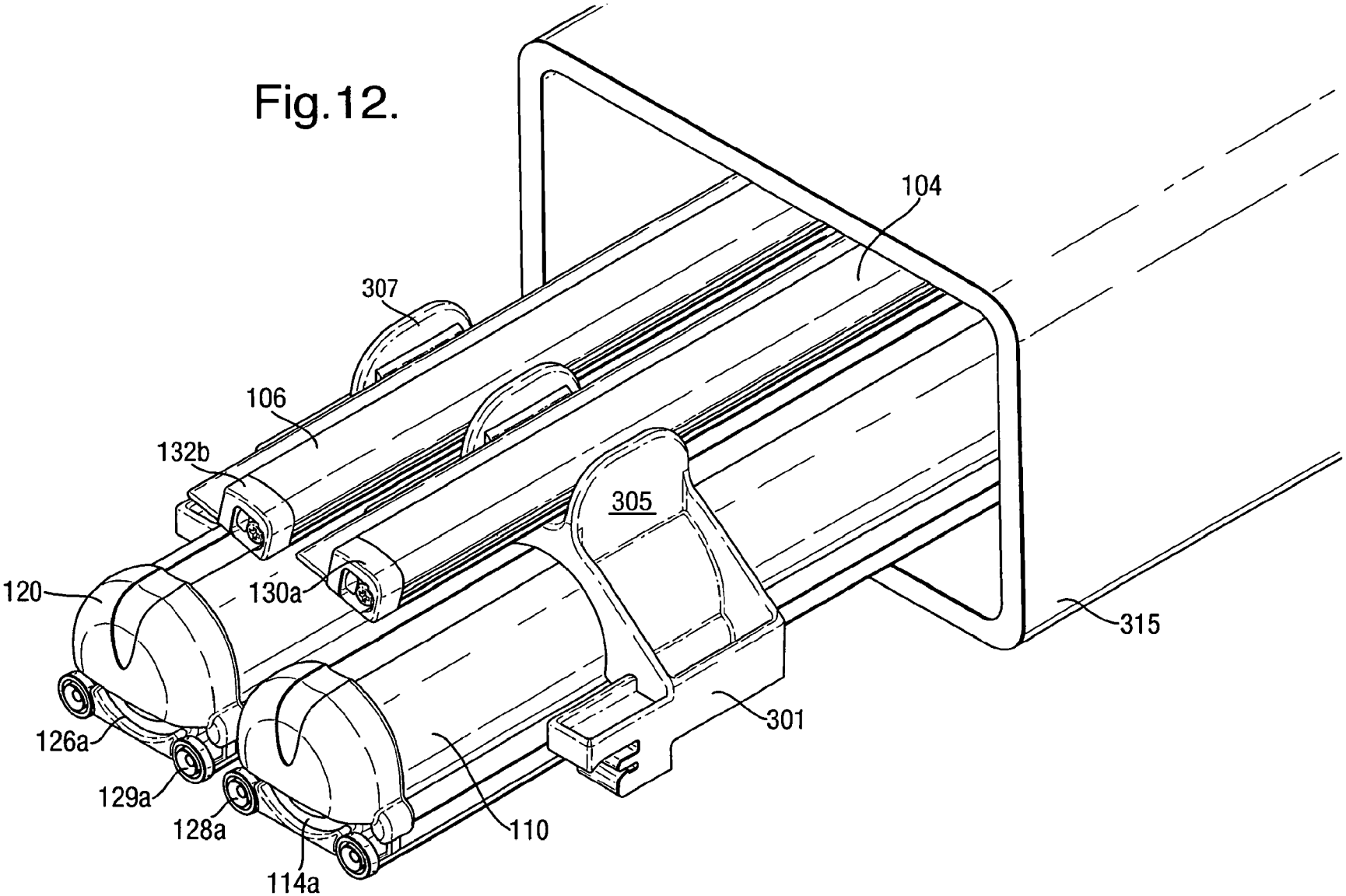
Figure 13:
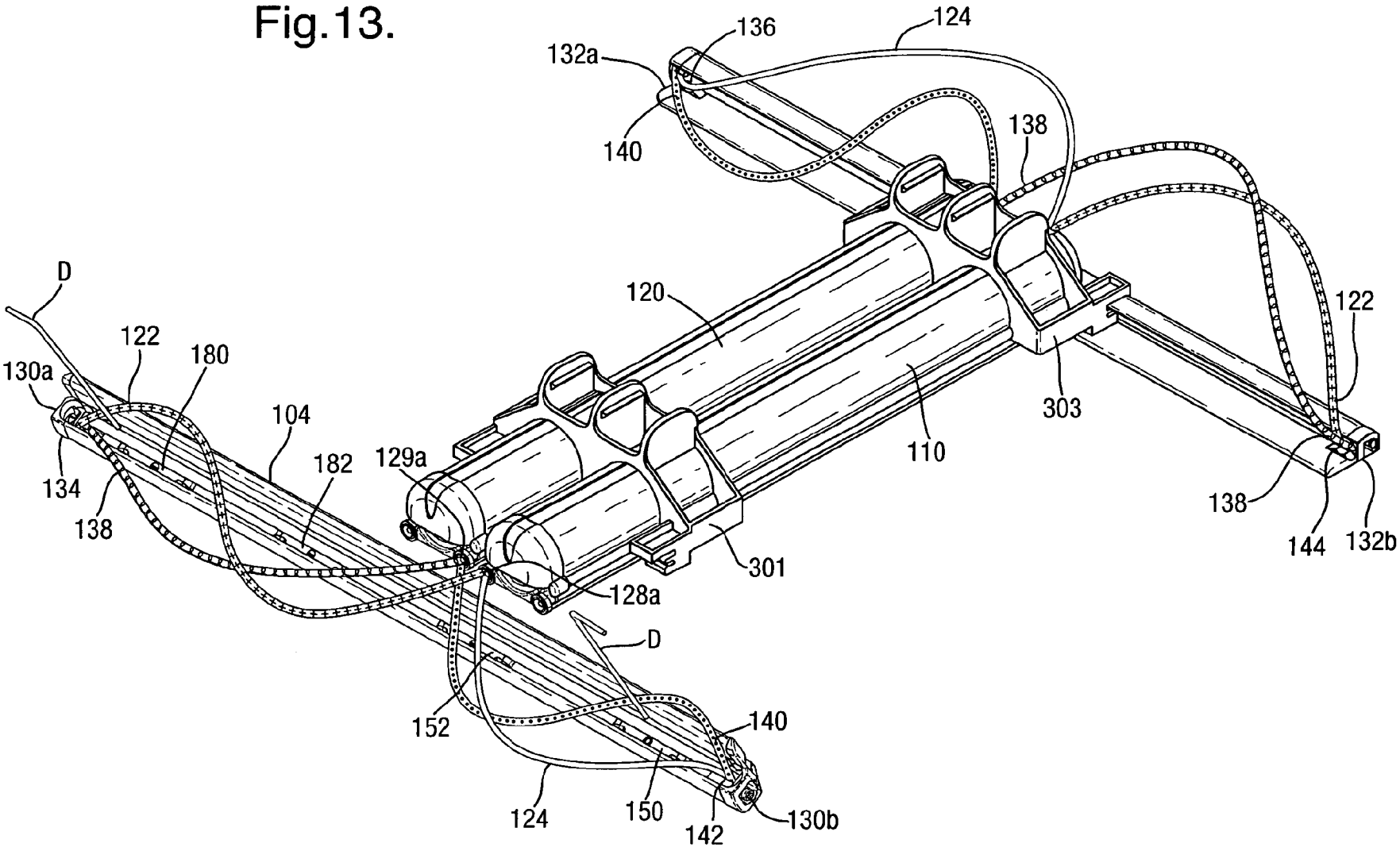
Figure 14A:
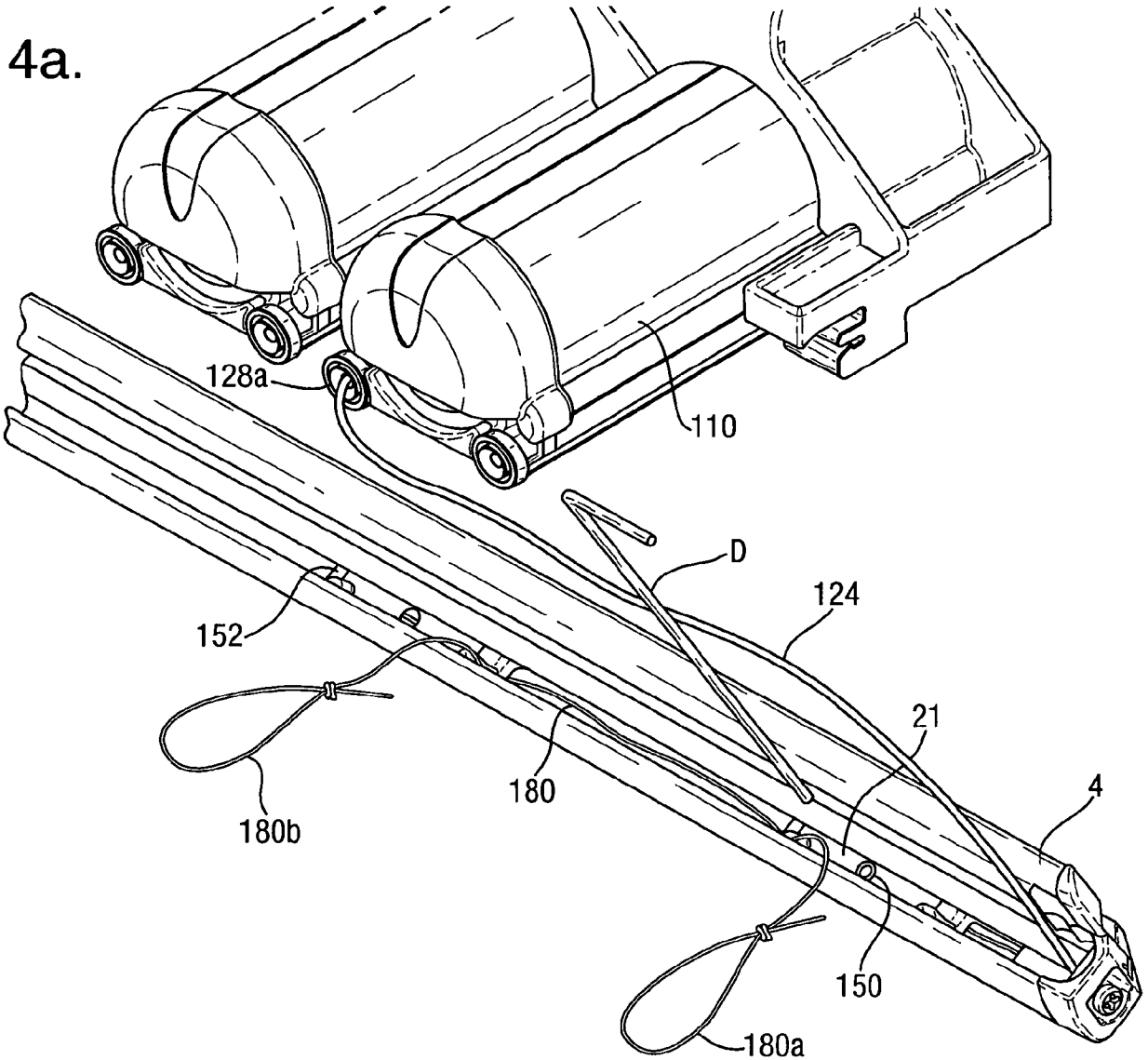
Figure 14B:
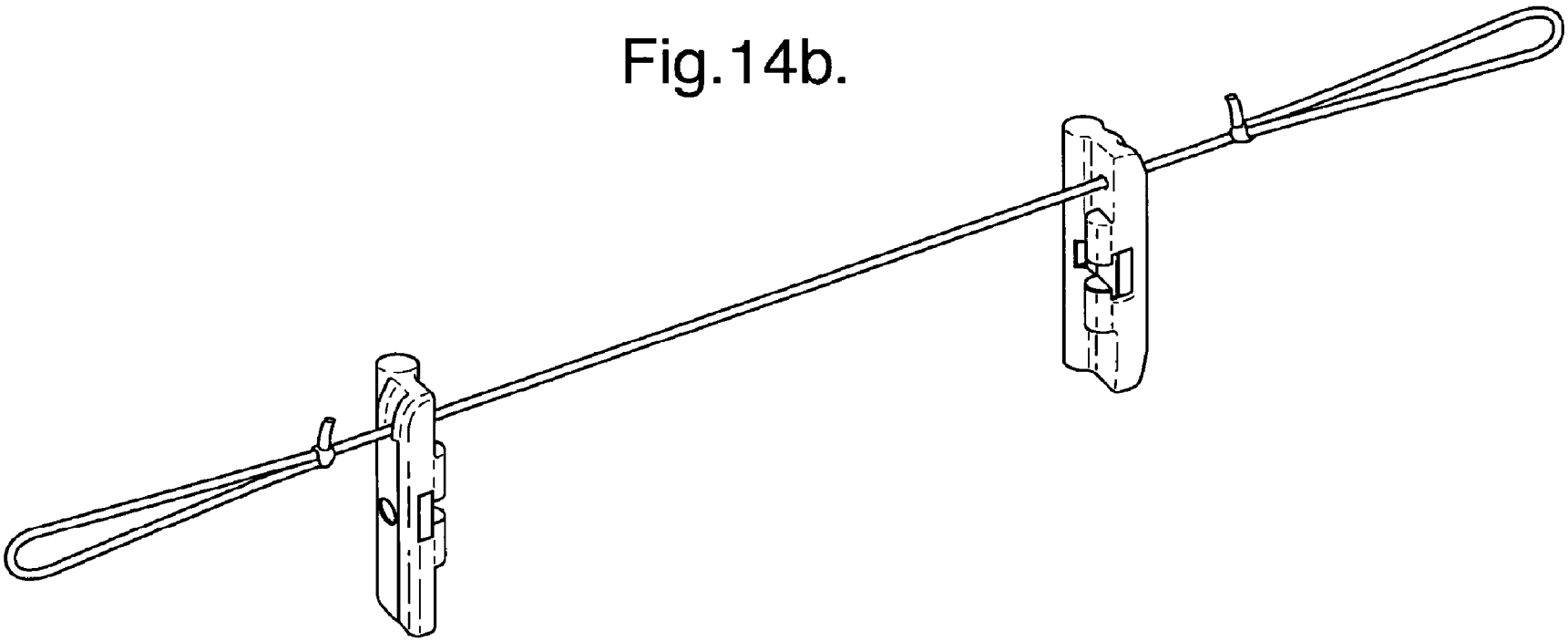
Figure 15:
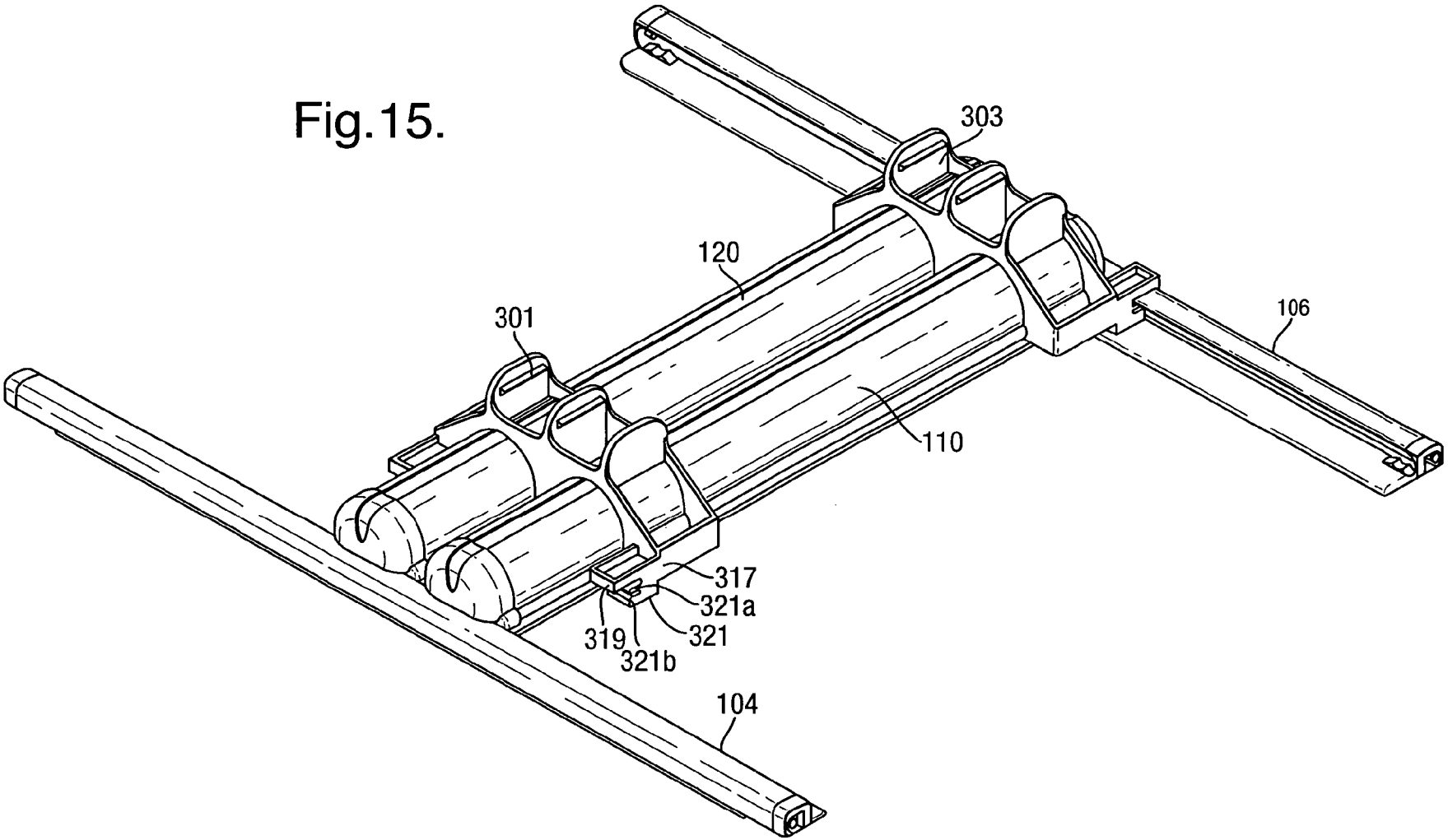
Figure 16:
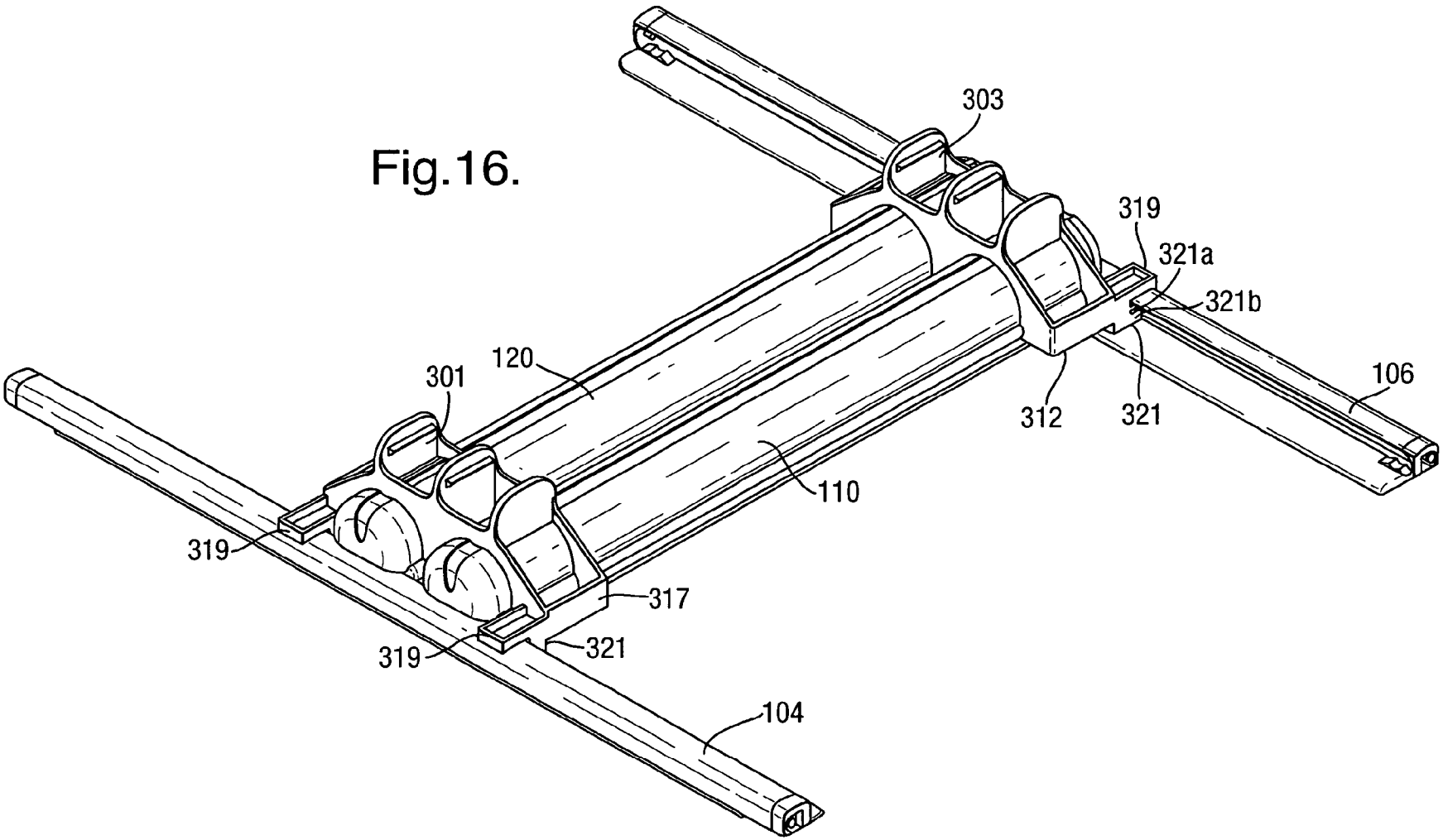
Figure 17:
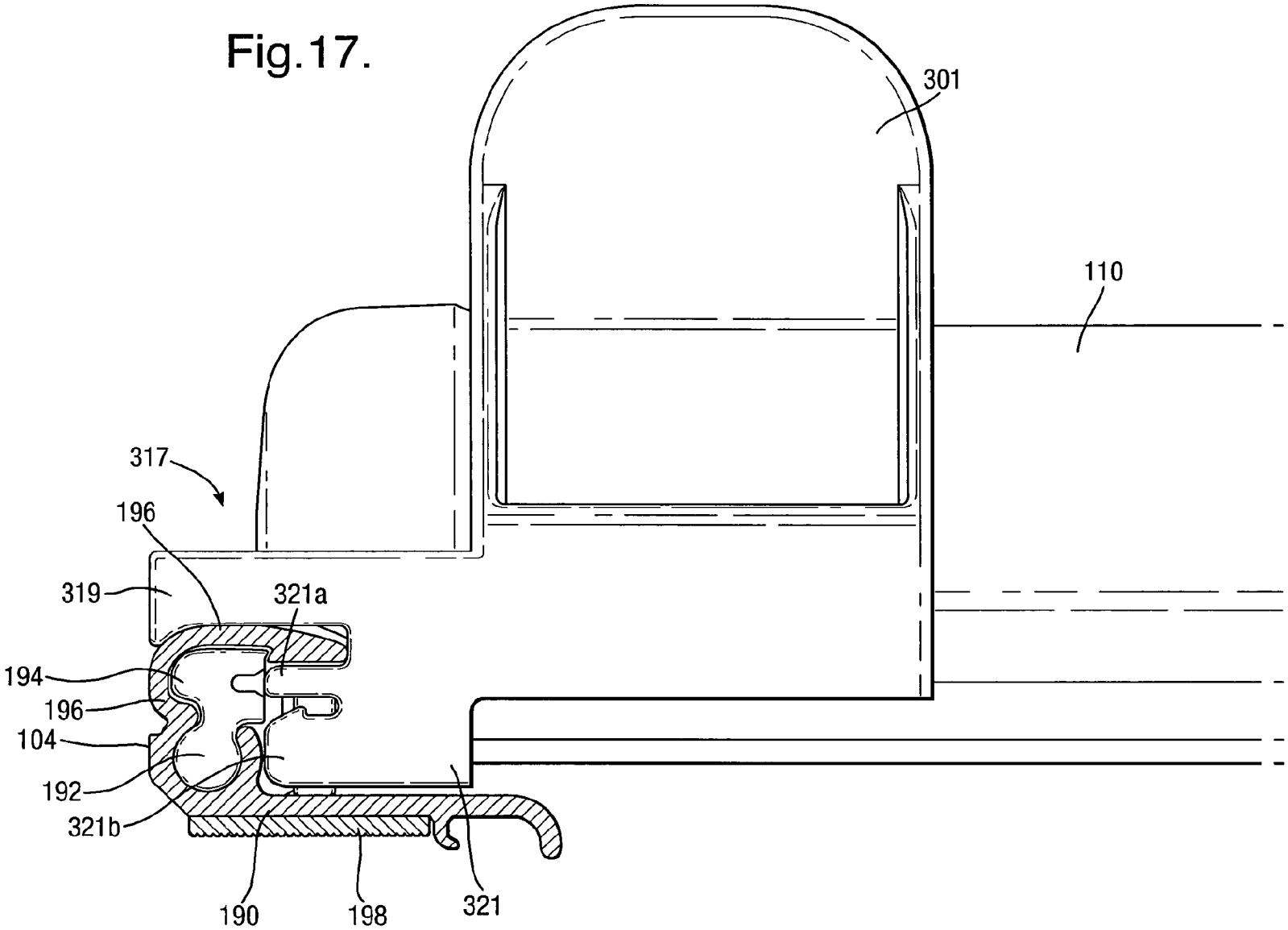
Figure 18:
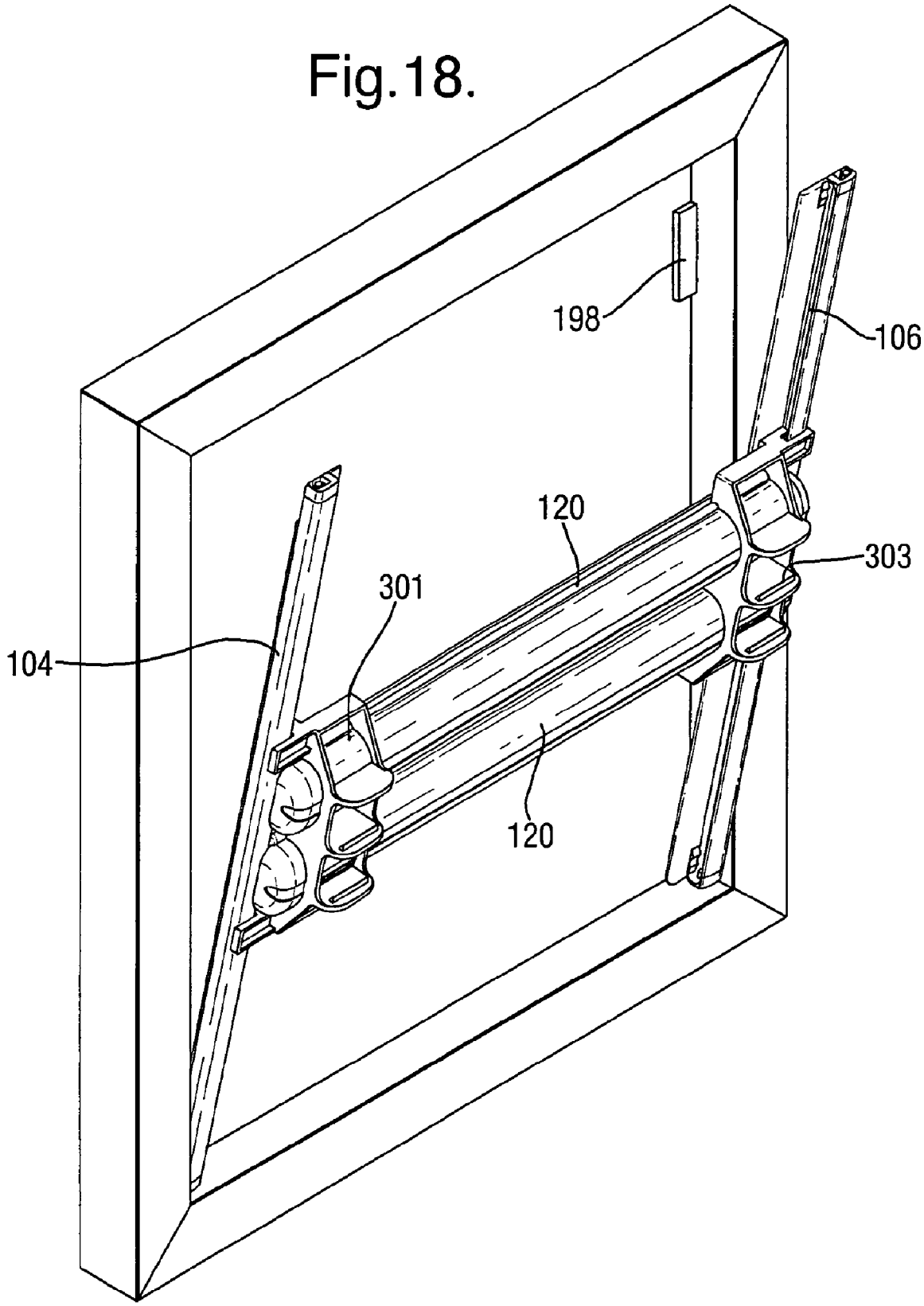
Figure 19:
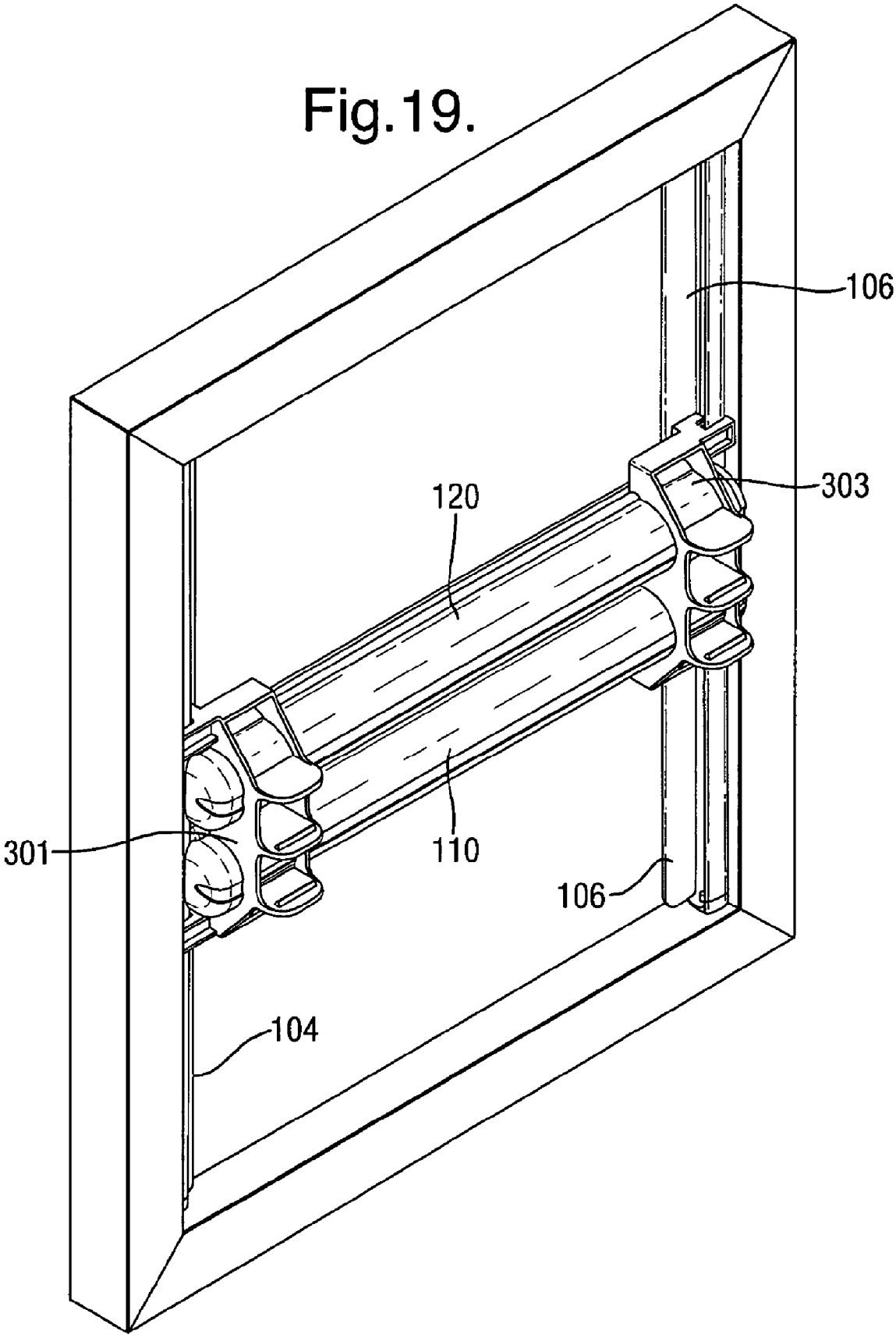
Figure 20:
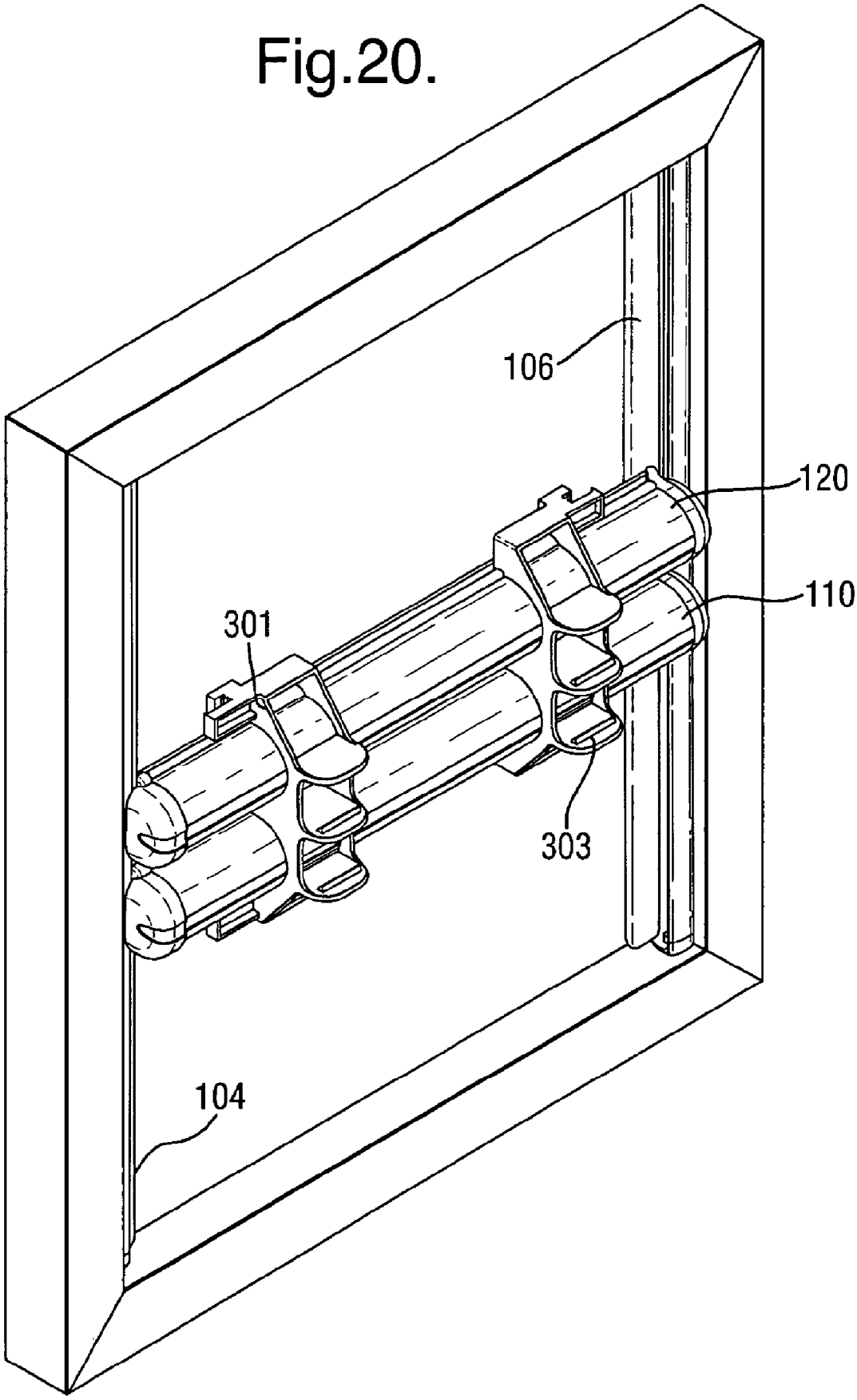
Figure 21:
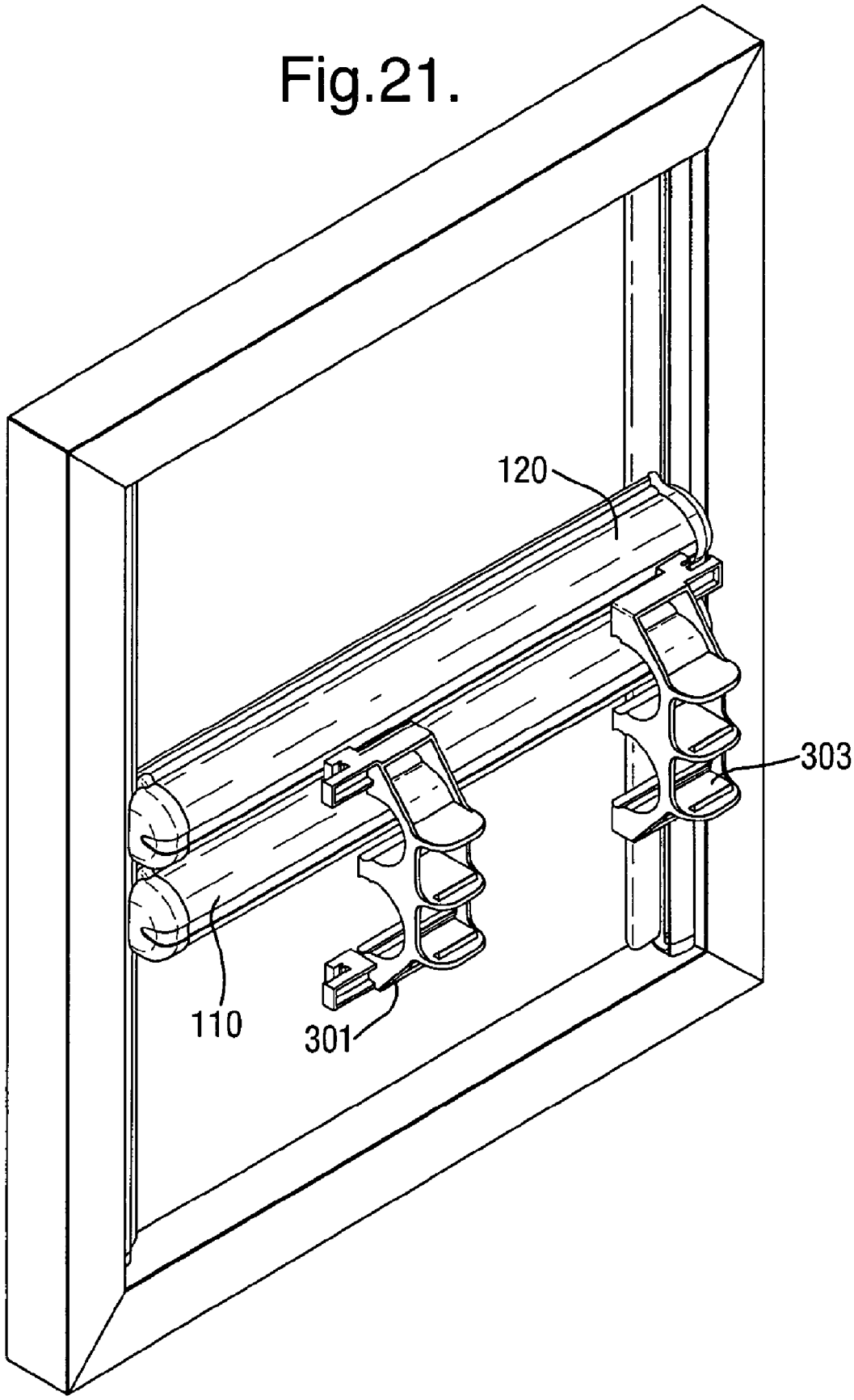
Figure 22:
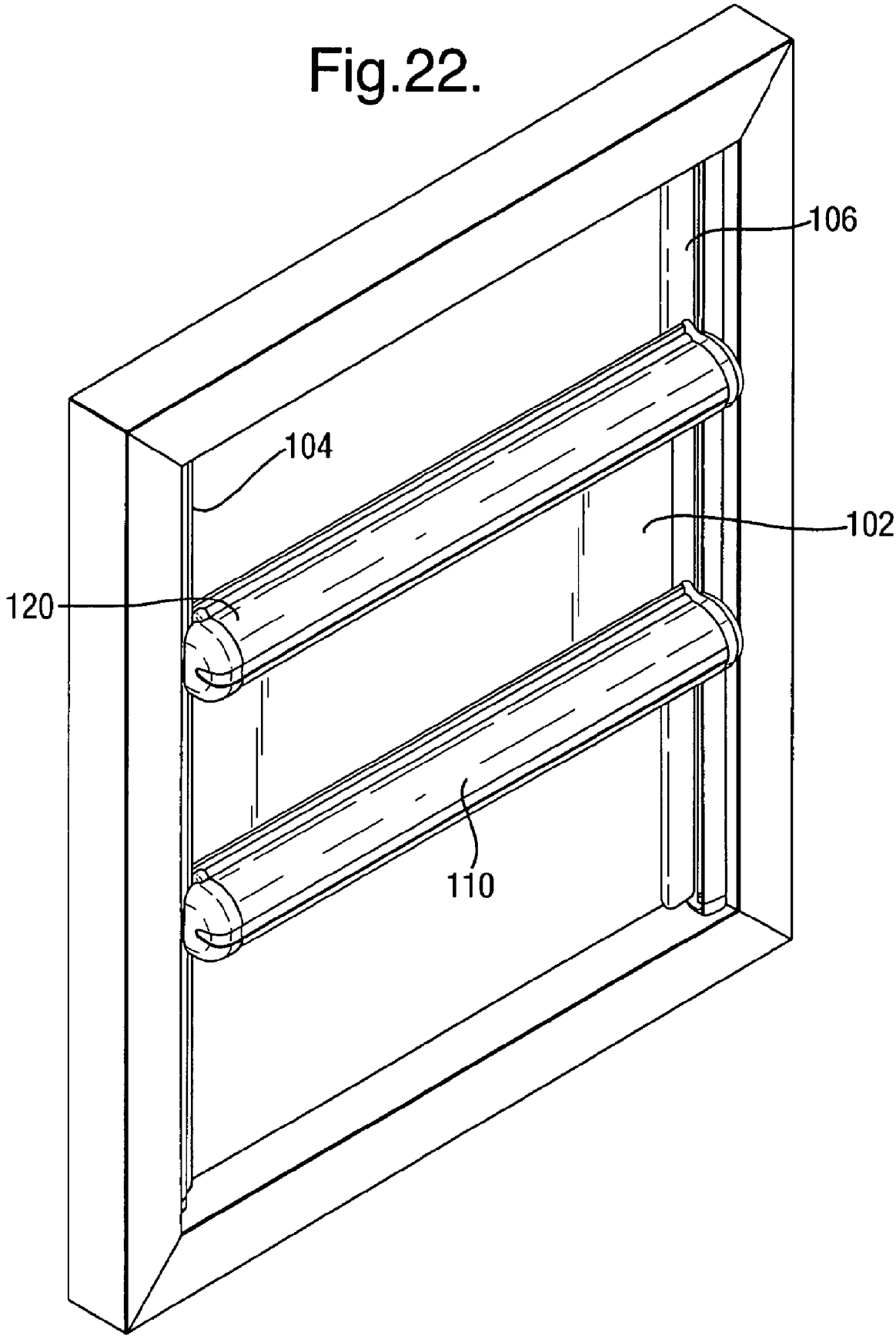
Figure 23:
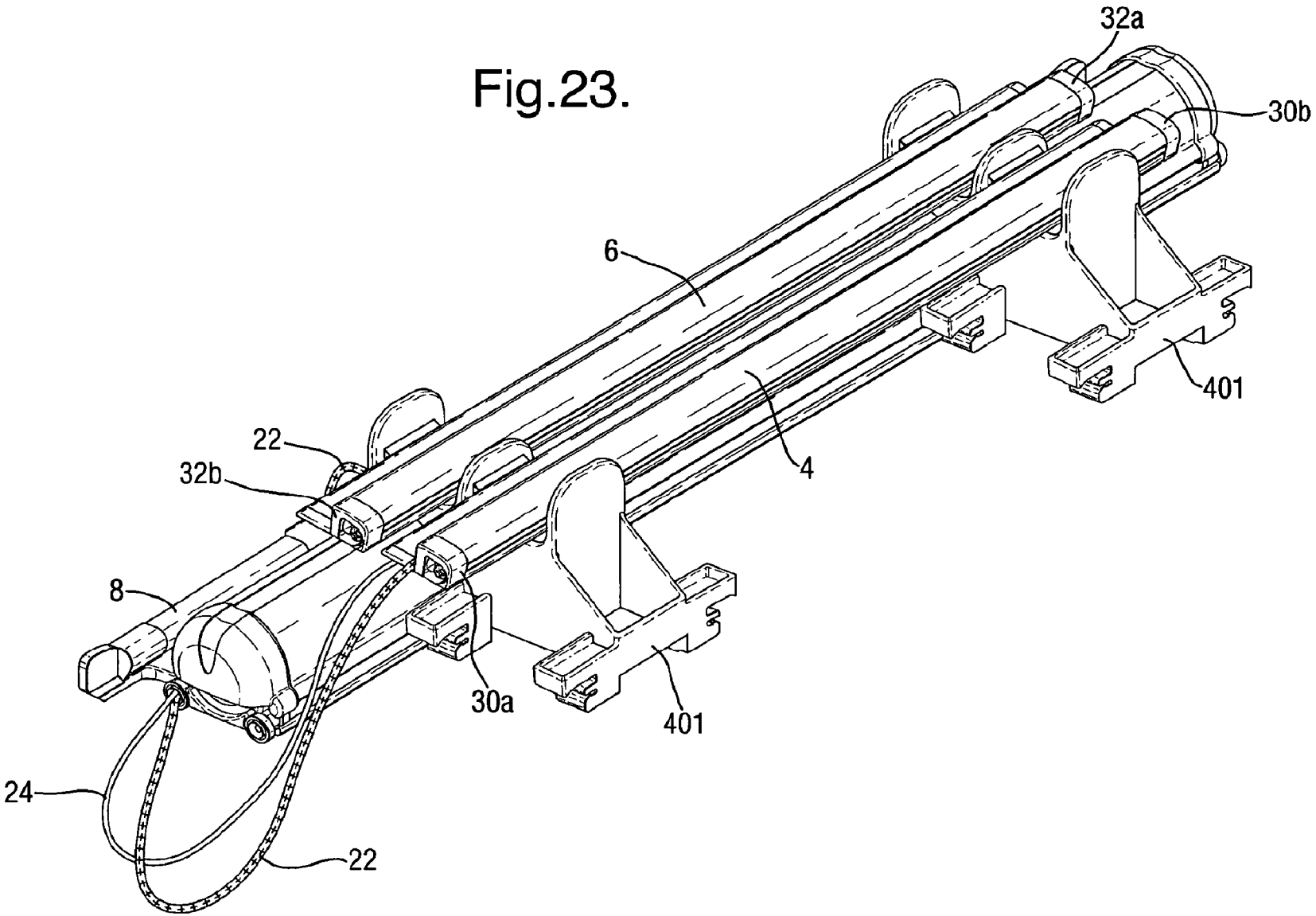
Figure 24A:
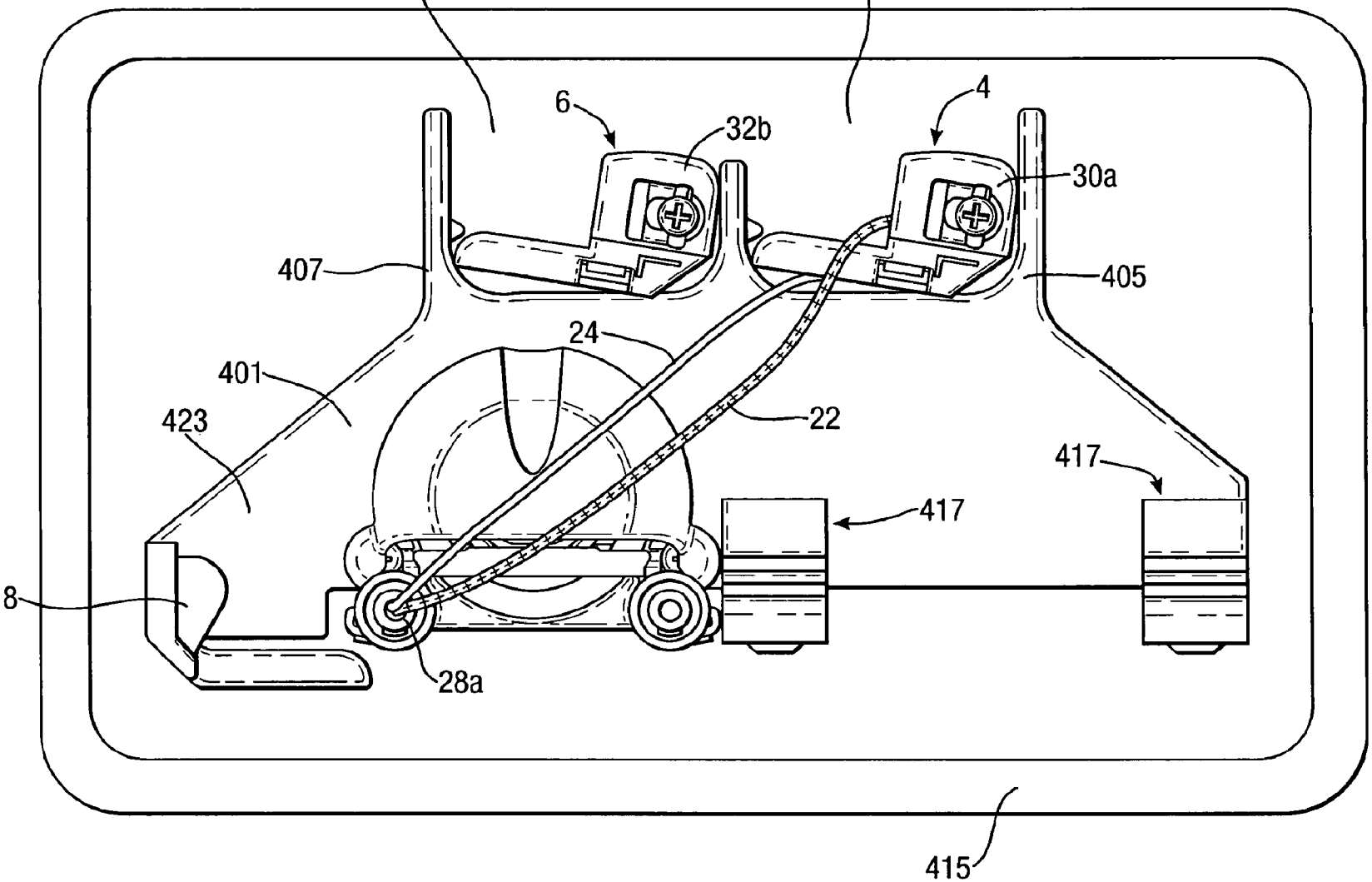
Figure 24B:
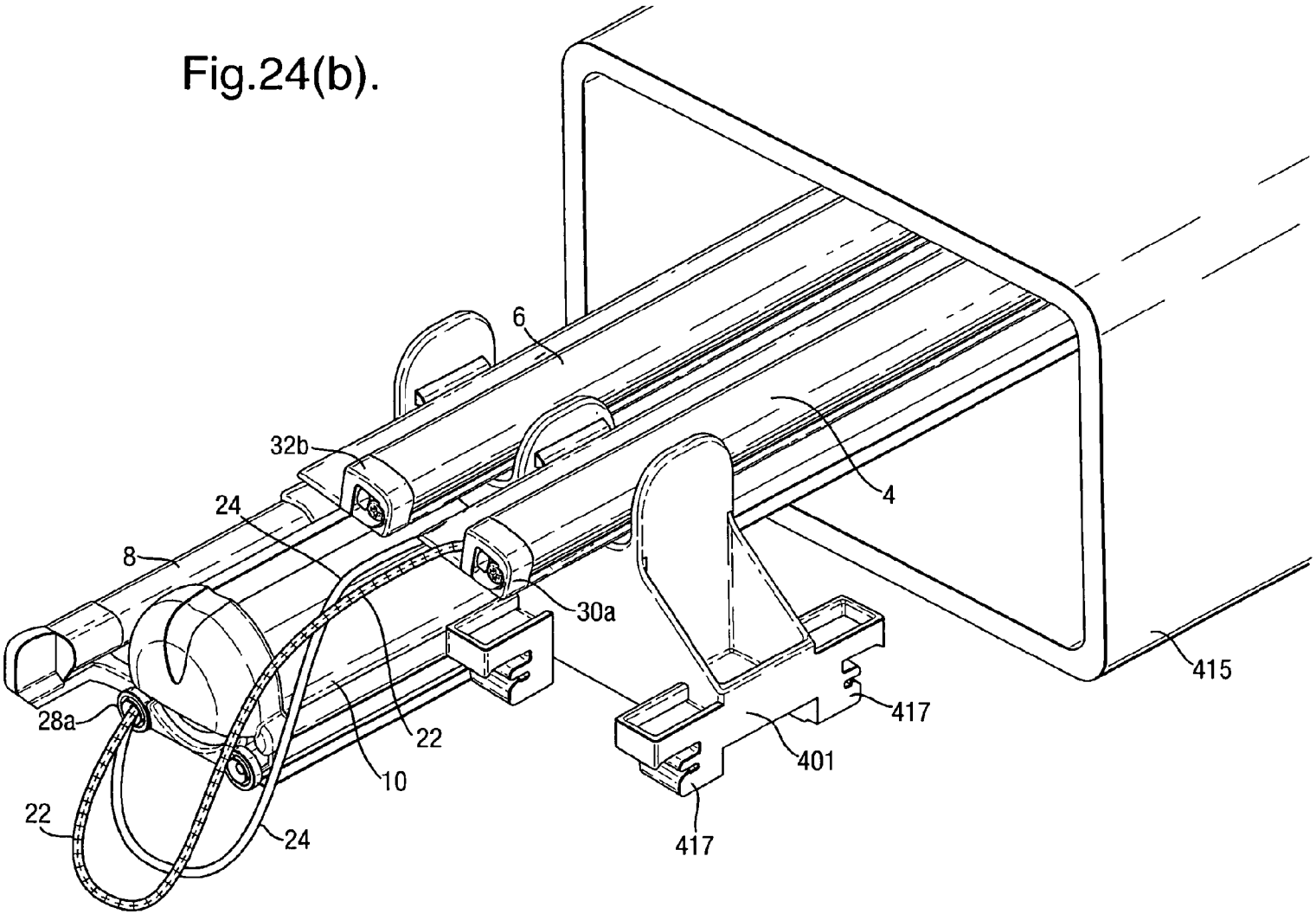
Figure 27:
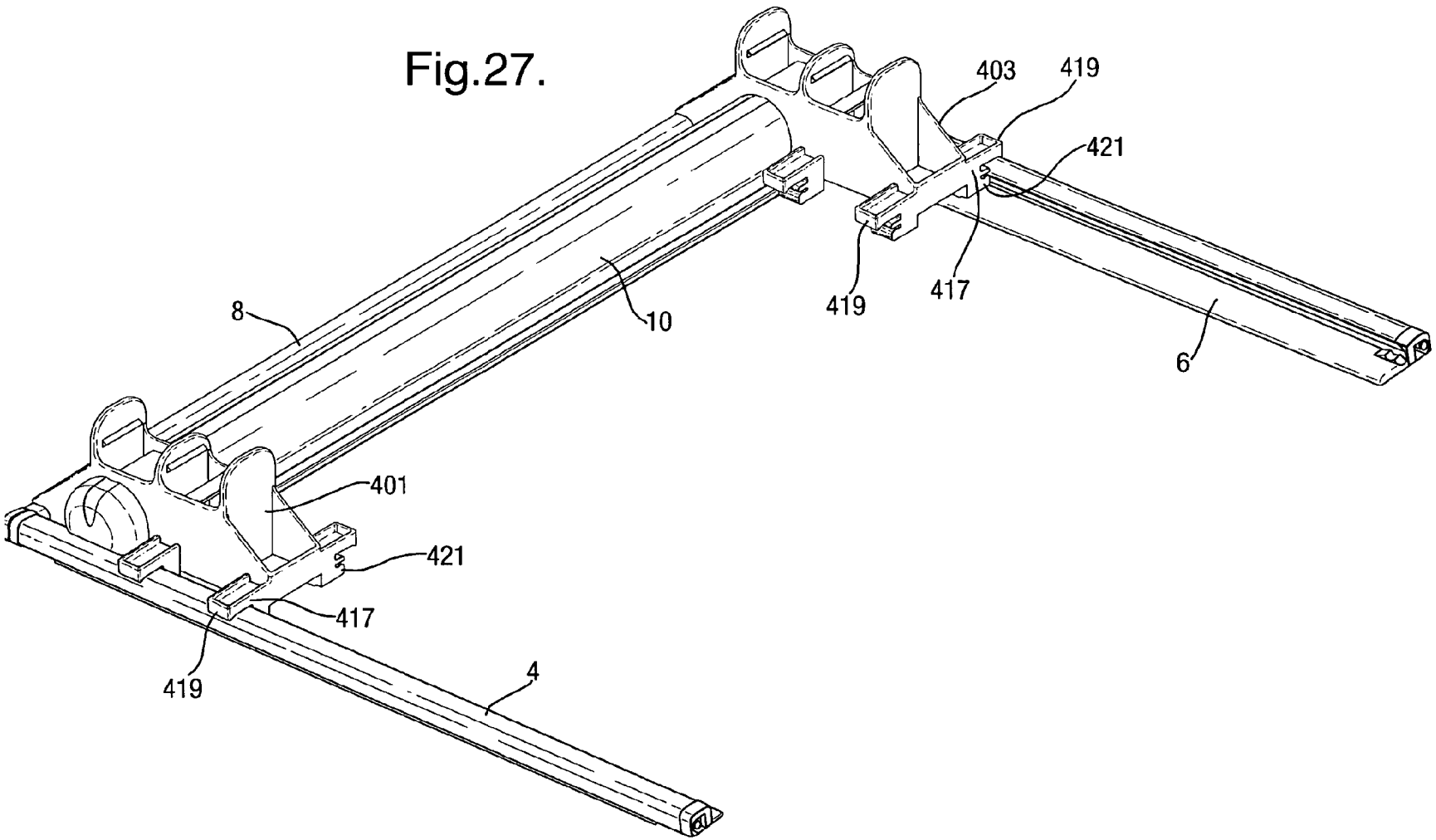
Figure 28:
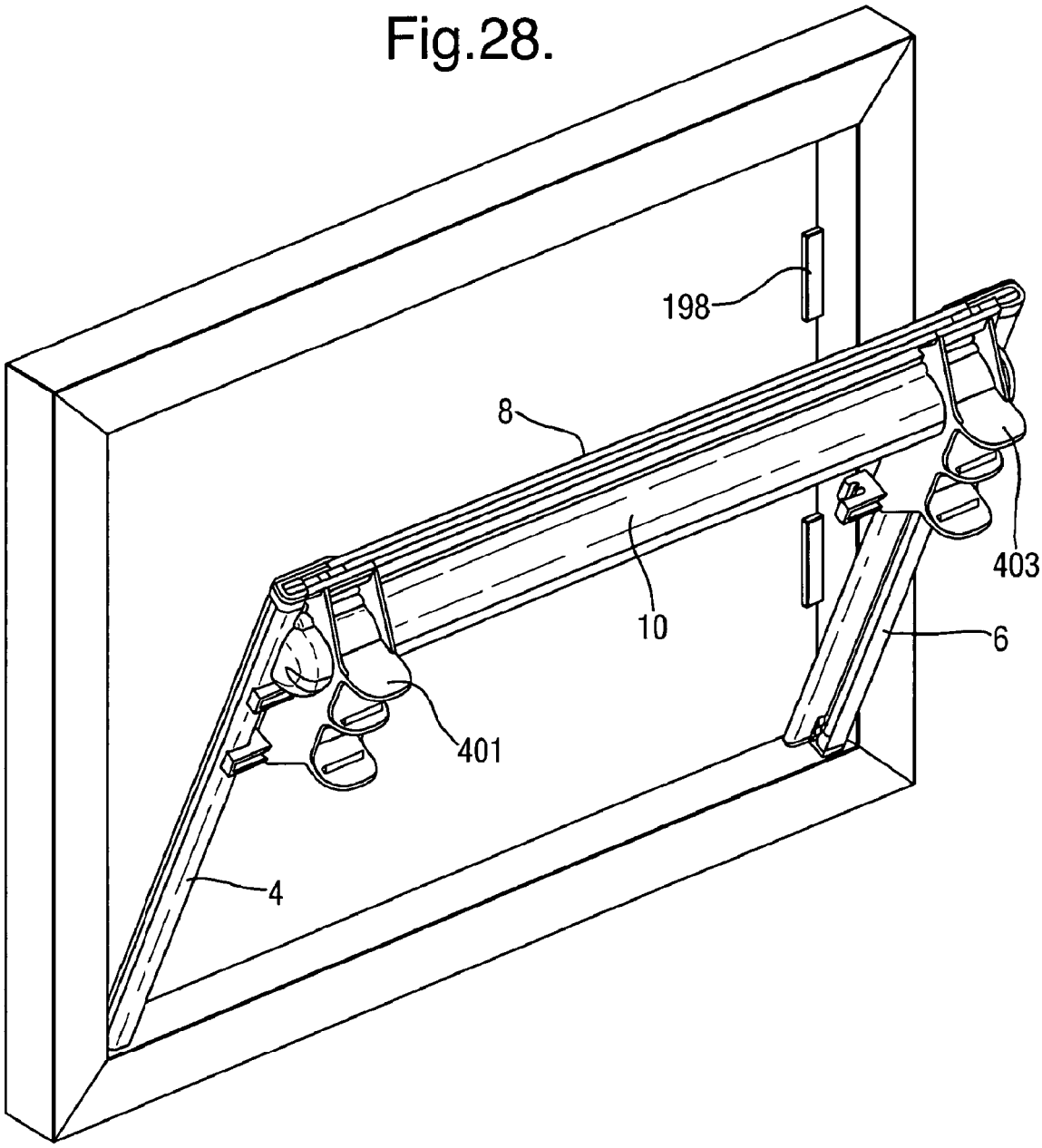
Figure 29:
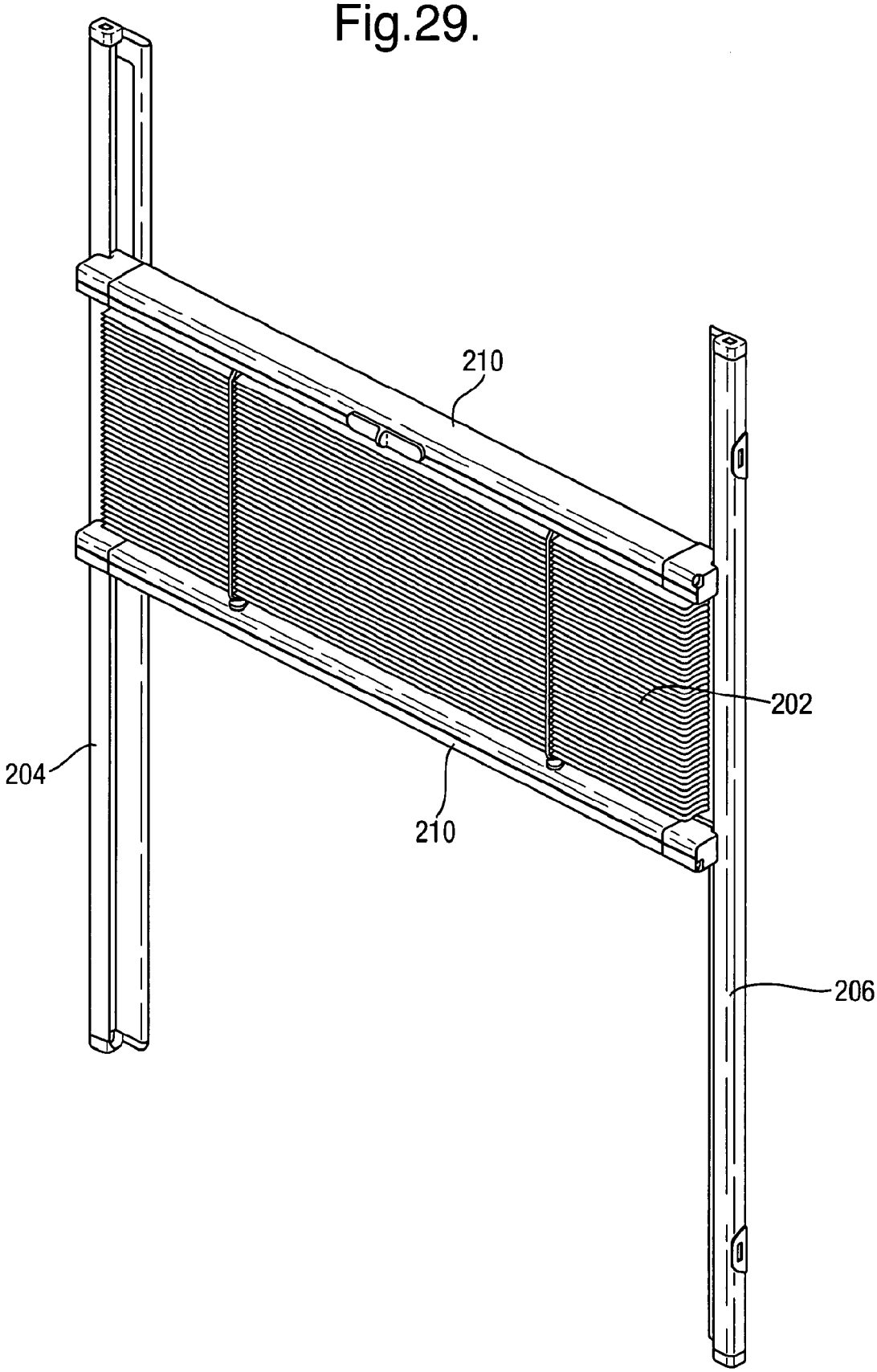
Figure 30:
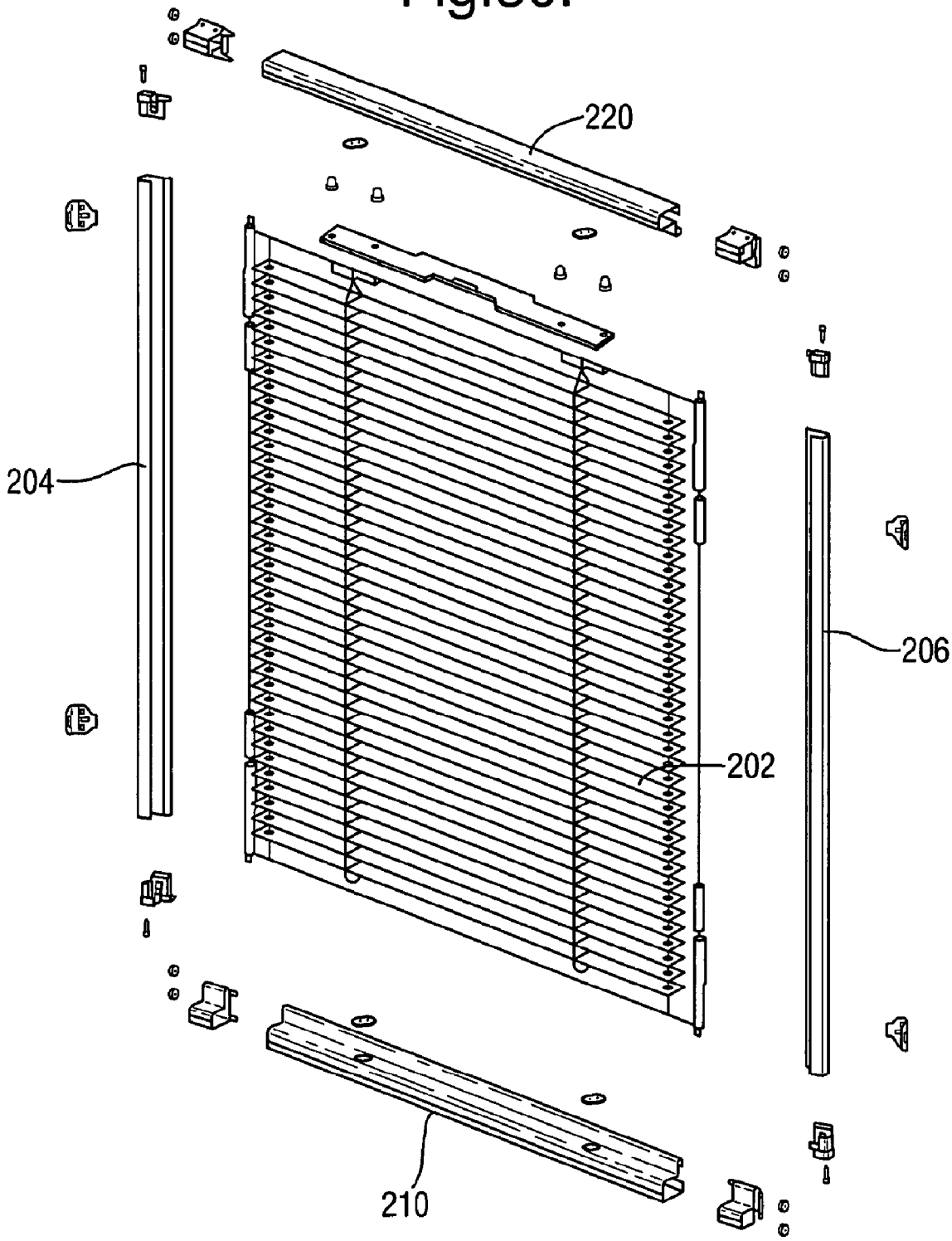

FIGS. 3(*a*), (*b*) and (*c*) illustrate a cord arrangement for use with the present invention;

FIGS. 4(*a*) and (*b*) illustrate a movable head rail;

FIGS. 5, 6 and 7 illustrate in further detail the spring bias arrangement of the movable head rail of FIGS. 4(*a*) and (*b*);

FIGS. 8 and 9 illustrate installation of the embodiment of FIG. 2 on a window pane;

FIG. 10 illustrates a variation of the embodiment of FIG. 2 assembled for packaging;

FIGS. 11(*a*) and (*b*) illustrate the assembly of FIG. 10 in a packaging tube;

FIG. 12 illustrates the assembly of FIG. 10 in an alternative packaging tube;

FIG. 13 illustrates the arrangement of FIG. 10 being assembled for use;

FIGS. 14(*a*) and (*b*) illustrate use of an adjuster cord;

FIGS. 15 and 16 illustrate the assembly of FIG. 10 being secured by use of package clamps;

FIG. 17 illustrates a packing clamp engaging with a side rail;

FIG. 18 illustrates the secured assembly of FIG. 16 being mounted to a window;

FIGS. 19, 20 and 21 illustrate removal of packing clamps from the assembly when secured to a window;

FIG. 22 illustrates use of the covering when secured to a window;

FIGS. 23, 24(*a*) and (*b*) illustrate a variation on the embodiment of FIG. 1 packaged with packing clamps;

FIGS. 25, 26, 27 and 28 illustrate assembling the component parts of FIG. 23 and mounting the window covering on a window for use; and FIGS. 29 and 30 illustrate an arrangement including a venetian blind as the window covering.

In one embodiment of the present invention, a covering may be fixed relative to one peripheral edge of an architectural opening by means of a fixed or immovable end rail. This is illustrated in FIG. 1.

A covering 2 is provided for covering an architectural opening. The first and second side rails 4 and 6 are provided for mounting in parallel on either side of the architectural opening. In the illustrated embodiment, an immovable end rail 8 is provided for mounting in such a manner that it extends between two corresponding ends 4*a* and 6*a* of the two side rails 4, 6 in a generally perpendicular direction.

With a first or upper end portion 2*a* of the covering 2 fixed to the fixed end rail 8, an opposite or lower end portion 2*b* of the covering 2 can be drawn across the architectural opening (downwardly as illustrated in FIG. 1) in parallel with the two side rails 4, 6.

A movable end rail 10 is attached to the opposite end portion 2*b* of the covering 2 and is used to draw the covering 2 across the architectural opening.

As illustrated, the movable end rail 10 includes a roller 12 which is rotatably mounted within a housing 14 and has secured to it the opposite end 2*b* of the covering 2. In this way, when the movable end rail 10 is moved towards the other end rail (the fixed or immovable end rail 8 in this embodiment), the roller 12 can be rotated about its axis so as to roll up the covering 2 within the housing 14. A spring bias arrangement 16 (to be discussed further below) is provided to spring bias the roller 12 in a direction to roll the covering 2 into the end rail 10 and housing 14.

Not illustrated in this Figure are the tension cords 22 and 24 that are routed through the moveable rail 10 in order to maintain the movable rail at any desired position when it is not being manipulated to extend or retract covering 2. First or left tension cord 22 is attached to a top end cap 30*a* by means of a compression spring 34 at the left top end 4*a* of left side rail 4 and extends downwardly to the moveable rail, through left housing end 14*a* along housing 14 to through right housing end 14*b* and down to lower end cap 32*b* at right lower end 6*b* of the right side rail 6. Second or right tension cord 24 is attached to a top end cap 32*a* by means of a compression spring 36 at the right top end 6*a* of right side rail 6 and extends downwardly to the moveable rail, through right housing end 14*b* a along housing 14 to through left housing end 14*a* and down to lower left end cap 30*b* at left lower end 4*b* of the left side rail 4.

FIG. 1 illustrates various other components used for attaching and mounting the various parts of the embodiment illustrated in FIG. 1. However, it will be appreciated that alternative mounting arrangements are possible for this and other embodiments.

In some embodiments, the covering is only long enough (in the direction of the extent of the side rails 4, 6) to cover approximately half of the architectural opening or at least extend along approximately only half of the extent of the side rails 4, 6. With this arrangement, it would be possible to provide another similar covering 2 and movable end rail 10, for instance extending up from second ends 4*b*, 6*b* of the side rails 4, 6. Of course, other arrangements are possible such as merely providing a longer covering 2. Preferably, the cover is long enough to cover the whole architectural opening.

FIG. 2 illustrates a second embodiment of the invention which is similar to the first embodiment of FIG. 1 and for which corresponding reference numerals (greater by 100) are used below for describing the same parts or corresponding parts. The second embodiment of FIG. 2 is an embodiment where the fixed end rail 8 is replaced by a further movable end rail. Thus, a first or upper end 102*a* of the covering 102 is attached to a second or upper roller 118 of a second movable end rail 120 and the opposite second end 102*b* of the covering 102 is attached to a first roller 112 of a first movable end rail 110.

In this way, a first portion of the covering 102 can be retracted into to the movable end rail 110 and the other portion of the covering 102 can be retracted into the other movable end covering 120. Of course, the same advantage could be achieved by having a fixed end rail at one end of the two side rails 4, 6, but with an internal retracting roller.

An advantage of having two movable end rollers 110, 120 is that, with the covering 102 only partially extended, it can be positioned wherever the user requires along the length of the side rails 104,106. Of course, this advantage can also be achieved with a movable end rail to which an end of the covering 102 is merely fixed and which does not have a retracting roller.

It will be appreciated that other similar arrangements can be provided with other types of covering, such as pleated coverings or venetian blinds.

FIG. 3(*a*) illustrates a guide cord arrangement for the embodiment of FIG. 2, though illustrates only the guide cords for the lower movable end rail 110. It should be appreciated that this guide cord structure is equally applicable to other embodiments, including those with movable end rails without the roller arrangement.

As illustrated, a first cord 122 is provided to extend from a first longitudinal end 104*a* of the left side rail 104, across the movable end rail 110 and to the second end 106*b* of the second or left side rail 106. In this preferred embodiment, a second cord 124 similarly extends from a first longitudinal right top end 106*a* of the side rail 106, then across the movable end rail 110 and to the second left lower longitudinal end 104*b* of the first side rail 104.

In the illustrated embodiments in FIGS. 1 and 2, the movable end rails 10, 110, 120 and the housings 14, 114, 126 associated therewith each include left and right housing ends 14*a*, 14*b*, 114*a*, 114*b*, 126*a*, 126*b* respectively adjacent the left and right side rails 4, 104, 6, 106. The housing ends are preferably provided with guides which, in the illustrated embodiment, are throughholes 28*a*, 28*b*, 128*a*, 128*b*, 129*a*, 129*b* through which the tension cords 22, 122, 24, 124 can pass. As illustrated, cords 122 and 124 both pass through the same throughhole 128*a* in left housing 114*a* and 128*b* in right housings end 114*b*. However, of course, separate respective throughholes could be provided for each cord 122 and 124. By means of the throughholes 128*a*, 128*b*, the cords 122, 124 are able to pass along the length of the movable end rail 110, within its housing 114.

This arrangement provides a very stable and secure positioning for the movable end rail.

The ends of the cords 122, 124 can be secured to the left and right side rails 104, 106 at their respective top end caps 130*a*, 132*a* by means of small coil springs 134 and 136 respectively. The end of the cord is attached to the coil spring, routed through the coil spring and about the end cap to run downwardly parallel to the coil spring and continue the routing as described above. The coil springs 134, 136 provide tension to the cords 122, 124 which provides the right amount of frictional resistance to movement the movable end rail 110 and arranges the abovementioned stable and secure positioning for the movable rail 110. Furthermore, compression of the coil springs 134, 136 allows assembly to be changed from a usable configuration with the movable rails 110, 120 perpendicular relative to the orientation of the left and right side rails 104, 106 to an orientation in which all rails (movable rails and side guide rails) are parallel to each other. This is particularly useful for packing and transportation. Similarly, in the first embodiment the fixed rail and the movable rail and the left and right side rails can also be oriented parallel to each other for packaging and shipping.

Each movable rail of the second embodiment is provided with a tension cord arrangement for stable and secure positioning thereof. The left and right housing ends 126*a*, 126*b* of the upper housing 126 of the upper movable rail 120 illustrated in FIG. 3(*a*) is threaded with their own pair of cords 138, 140 (not illustrated in this Figure). The cord routing of these cords 138, 140 is in the reverse pattern to the first pair of cords 122,124 for the lower movable rail 110. In other words the ends of these third and fourth cords 138, 140 can be secured to the left and right side rails 104, 106 at their respective bottom end caps 130*b*, 132*b* by means of small coil springs 142 and 144 respectively. The end of the cord is attached to the coil spring, routed through the coil spring and about the end cap to run upwardly parallel to the coil spring and continue the routing. For the third cord 138 this means that the cord is routed up along the left side guide 104, to housing end 126*a* of the housing 126 of the upper movable rail 120, across the movable rail to the right housing end 126*a* and up to the right upper end cap 132*a* of the right side rail 106. For the fourth cord 140 this means that the cord is routed up along the right side guide 106, to housing end 126*b* of the housing 126 of the upper movable rail 120, across the movable rail to the left housing end 126*b* and up to the left upper end cap 130*a* of the left side rail 104. The coil springs 140, 142 provide tension to the third and fourth cords 138, 140 which provides the right amount of frictional resistance to movement the movable end rail 120 and arranges the abovementioned stable and secure positioning for the movable rail.

In order to allow the side rails 4, 6, 104, 106 to be twisted and laid parallel to the all movable and/or fixed rails 8, 10, 110, 120 of the first or second embodiment of the invention, it is desirable to have some excess length of cord 22, 242, 122, 124, 138, 140 to operate with instead of solely relying on the size of the springs 34, 36, 134, 136, 142, 144 to provide this length.

Figure 3A:
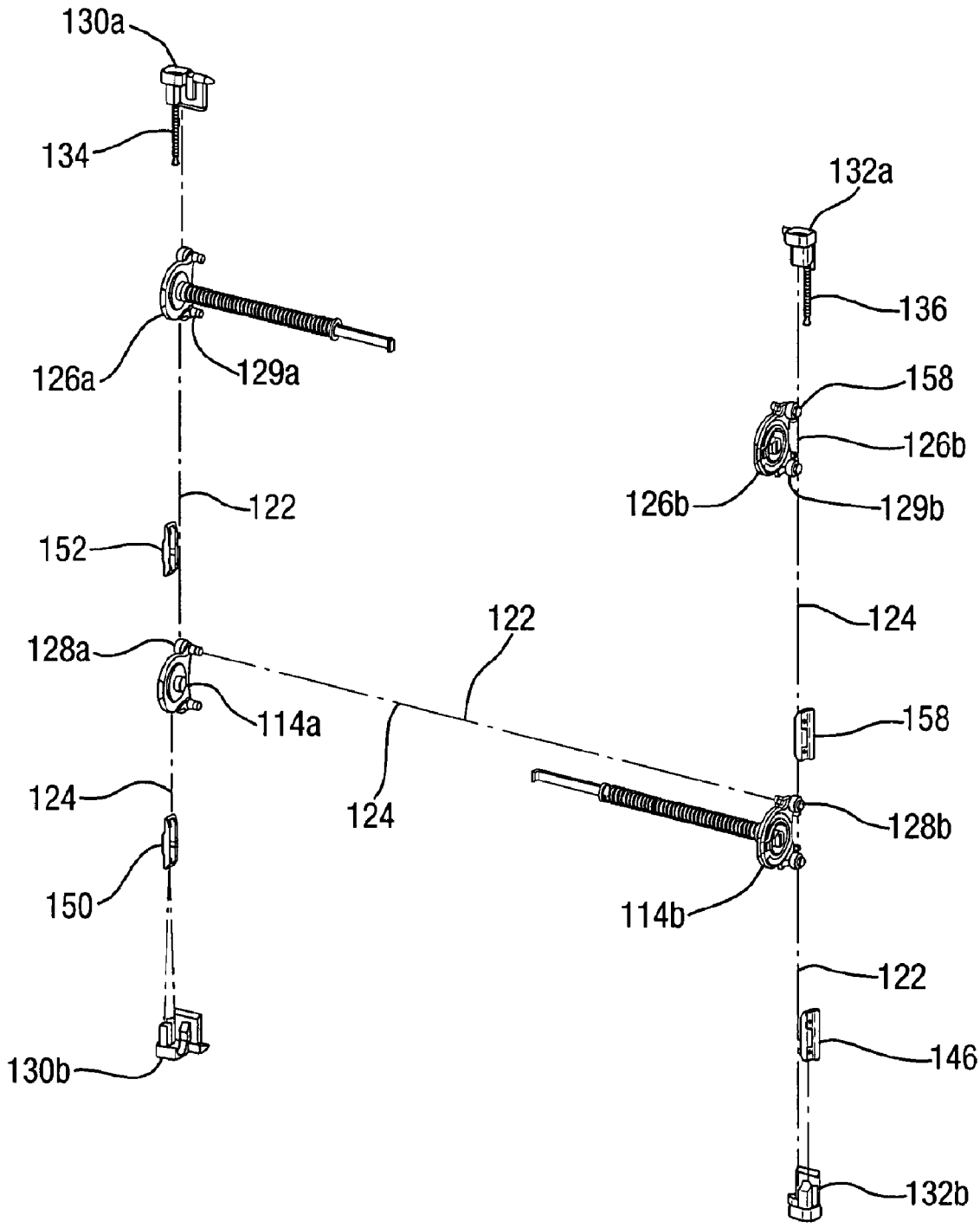
Figure 3B:
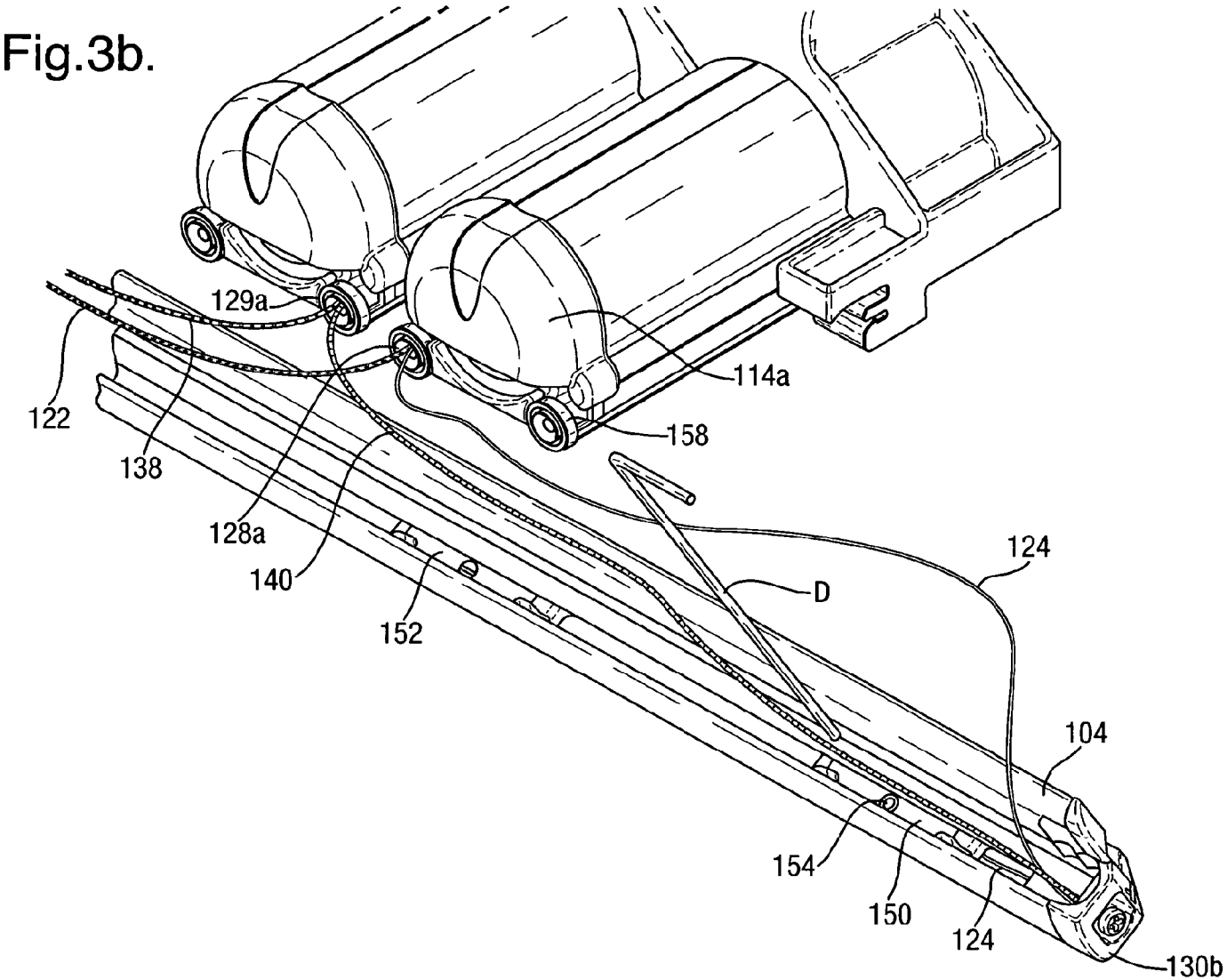
Figure 3C:
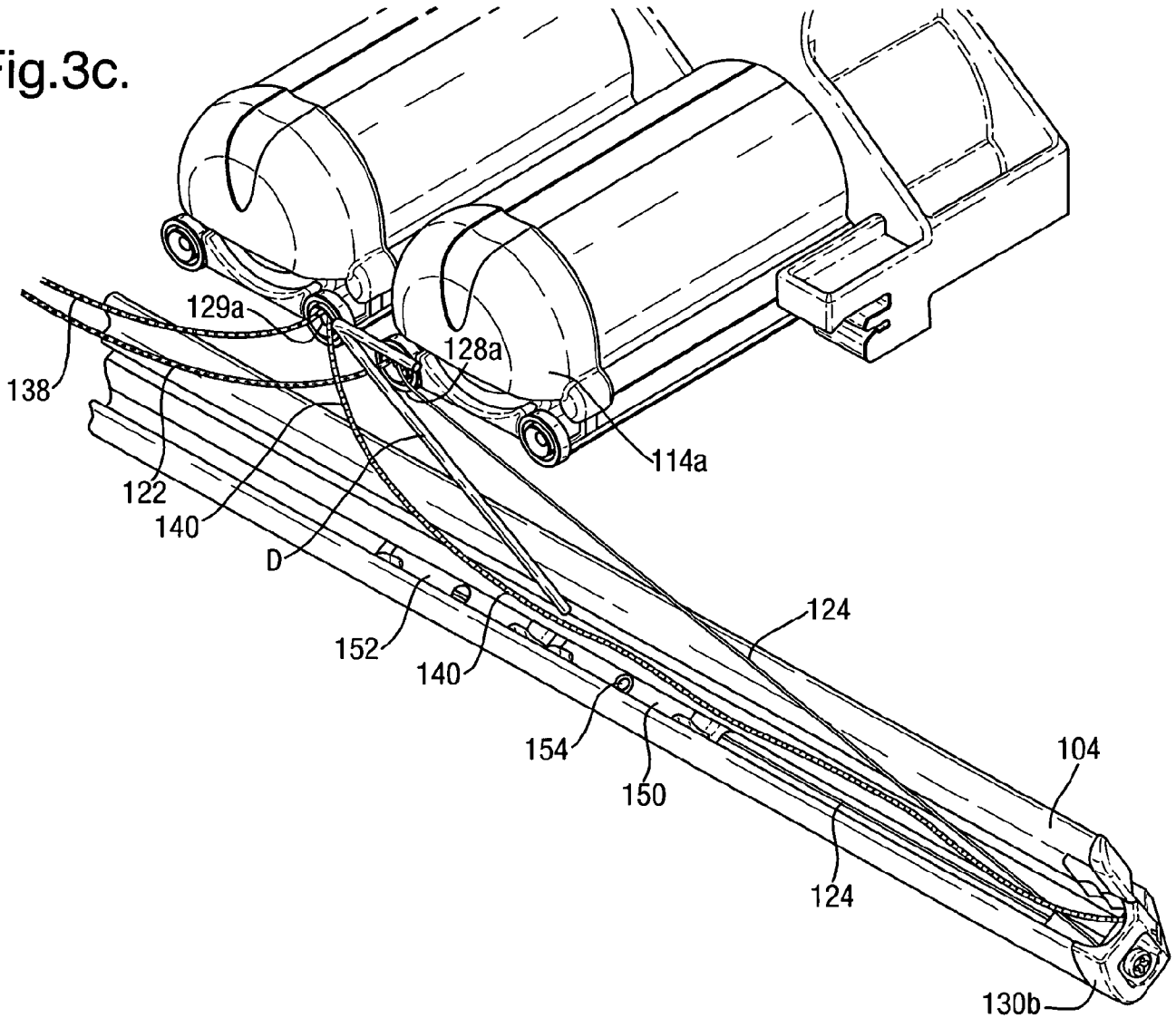

The tension cords are therefore provided with an excess length, which is best illustrated in the cords 122, 124 in the FIGS. 3*a*-3*c*. Cord 122 is attached to the tension spring 134 at upper left cap 130*a* of left side guide rail 104, routed through the spring, about end cap 130*a* (or through a channel provided therein) and down to left housing end 114*a* turning the corner through opening 128*a* and across to right housing end 114*b*, turning the corner at the opening 128*b* at housing end 114*b* and down to lower right end cap 132*b*, looped about this end cap (or through a channel arrangement in the end cap), and up to the lower right adjuster block 146 to be attached to this lower right adjuster block. At a distance above the lower right adjuster block is shown a stopper block 148.

FIG. 3(*b*) illustrates how the excess length is provided for the other cord of the first pair of tension cords, the second cord 124 before installation of the covering. Cord 124 is attached to the tension spring 136 at upper right cap 132*a* of right side guide rail 106, routed through the spring, about end cap 132*a* (or through a channel provided therein) and down to right housing end 114*b* turning the corner through opening 128*b* and across to left housing end 114*a*, turning the corner at the opening 128*a* at housing end 114*a* and down to lower left end cap 130*b*, looped about this end cap (or through a channel arrangement in the end cap), and up to the lower left adjuster block 150 to be attached to this lower left adjuster block. At a distance above the lower left adjuster block is shown a left stopper block 152 The adjuster block 150 to which the end of the cord 124 is attached is generally slidable along the side rail 104 and, as illustrated, is positioned close to the end 104*b* of the end cap 130*b* of the left side rail 104, in particular looping around a portion (not illustrated) of the end cap 130*b*. Upon installation, the left lower adjuster block 150 may be slid along the side rail 104 away from the lower end 104*b* of the side rail 104 and the lower end cap 130*b* as illustrated in FIG. 3(*c*). A length of the cord 122 is thus caused to extend from the end cap 130*b* to the adjuster block 150 so as to take-up the previously provided excess cord length. In the illustrated embodiment, the adjuster block 150 is provided with a threaded member 154 a which can be tightened, for instance with driver D, so as to hold the adjuster block 150 in place. Also, a stopper block 152 may be provided at a predetermined location along the length of the side rail 104, allowing a user to correctly position the adjuster block 150 by abutting the adjuster block 150 against the stopper block 152 and achieve the desired "in-use" tension for cord 124

Where three or more movable end rails are provided along the same side rails 4, 6, 104, 106 similar cord arrangements can be provided.

Referring again to FIGS. 1 and 2, it will be seen that the side rails 4, 6, 104, 106 are formed as elongate channels which face each other across the width of the assembly and architectural opening. In the preferred embodiment, the channel wall adjacent the architectural opening is longer than that away from the architectural opening. This facilitates mounting of movable end rails in that the movable end rail can be inserted between the facing walls further from the architectural opening until the ends of the movable end rail abut the facing walls nearer the architectural opening.

The housing ends 14*a*, 14*b*, 114*a*, 114*b*, 126*a*, 126*b* are shaped so as to interact with the shape of tile side rails 4, 6, 104, 106 and thereby assist the guiding of the movable end rail 10, 110, 120. In particular, at least a portion of each of the housing ends 14*a*, 14*b*, 114*a*, 114*b*, 126*a*, 126*b* is arranged to protrude into the respective channel section of the side rail 4, 6, 104, 106.

In the illustrated embodiment, the protrusion is formed by a pair of shafts 56, 156, upon which annular members 58, 158 are rotatably mounted as wheels to form bearings. The annular members 58, 158 fit into the channel sections of the side rails 4, 6, 104, 106. In particular, the annular members 58, 158 are rotationally mounted about respective axes parallel to the longitudinal extent of the movable end rail. Each movable member has an outer diameter similar to the spacing between the opposing walls of a side rail 4, 6, 104, 106 forming the channel, and the pair of annular members 58, 158 are arranged side by side in the direction of extent of the side rail 104, 106 and its channel. In this way, the movable end rail 10, 110, 120 is more firmly and securely supported for movement along the side rails 4, 6, 104, 106.

FIG. 4(*a*) illustrates an assembled movable end rail and FIG. 4(*b*) is an exploded view of the component parts of that movable end rail.

It will be seen that a finishing cap 60 is provided over each housing end 14*a*, 14*b* to close the housing 14 and provide a good appearance.

The spring bias arrangement 16 will be described in further detail with reference to FIGS. 5, 6 and 7.

A coil spring 62 is provided co-axially with the roller 12 and, when assembled, is positioned within the roller 12. A first end 64 of the coil spring 62 is mounted securely around a drive-spring end 66. The drive spring end 66 is generally cylindrical. It has a smaller-diameter portion about which the coil spring 62 is mounted and grips and a large-diameter portion which forms an end cap for the roller 12. As illustrated, the roller 12 includes at its end a cutout 68 at one portion of its circumference. The cutout 68 can engage with a protrusion on the outer periphery of the drive-spring end 66 so as to be fixed rotationally with it when the spring 62 and drive-spring end 66 are inserted in the roller 12.

The opposite end 70 of the spring 62 engages a floating-spring end 72 which, like the drive-spring end, is generally cylindrical and has an outer portion around which the end 70 of the spring 62 securely fits and grips.

The housing end 14*b* is provided with a slotted throughhole 74 at its centre, in other words concentric with the axis of rotation of the roller 12.

An elongate member 76 is arranged to fit into the slotted throughhole 74 and extend along the axis of the roller 12 within the drive-spring end 66 and floating-spring end 72. In the illustrated embodiment, this member takes the form of an elongate bar having a rectangular cross-section corresponding to that of the slotted throughhole 74.

As best illustrated in the cross-section of FIG. 7, the floating-spring end 72 includes another slotted throughhole 78 having approximately the dimensions of the cross-section of the member 76. In this way, the floating-spring end 72 is free to move or float in an axial direction along the member 76. However, the floating-spring end 72 is rotationally fixed relative to the member 76 by virtue of the corresponding shape/size of the aperture 78 and outer cross-section of the member 76.

At this point, it should be appreciated that a variety of different shapes and sizes can be provided in place of the slotted throughhole 74, slotted throughhole 78 and member 76. All that is necessary is that the floating-spring end 72 has a fixed rotational position relative to the housing end 14*b*, but can move freely in an axial direction.

Considering now operation of the device of FIG. 1, when the movable end rail is moved so as to unwind the cover 2 from the housing 14, the roller 12 rotates correspondingly. As the roller 12 rotates relative to the housing 14, the drive-spring end 66 is rotated and, hence, the end 64 of the spring 62 is rotated. The winding direction of the spring 62 is arranged such that this unrolling of the cover 2 unwinds the spring 62. Because the floating-spring end 72 to which the end 70 of the spring 62 is attached is free to move in an axial direction, as the spring 62 is unwound, the end 70 of the spring 62 and the floating-spring end 72 move axially along the member 76 away from the housing end 14*b*. Because the unwinding of the spring 62 does not cause expansion in a radial direction of the spring 62, the roller 12 can be maintained with a small diameter around the spring 62. As a result, the overall dimensions of the movable end rail 10 can be kept small.

It will be appreciated that many other arrangements are possible whereby the retraction spring of the device is allowed to extend in length axially so as to keep a small diameter.

Of course, when the movable end rail is moved so as to retract the covering 2, the spring 62 rewinds, thereby rotating the roller 12 to take up the cover 2.

It should be appreciated that, in general, it is desirable to have some tension in the spring 62 even when the cover 2 is fully rewound. In this respect, the illustrated embodiment allows easy adjustment by rotating the member 76 relative to the slotted throughhole 74 for the fully rewound position.

The various features described above allow significant miniaturisation of components of the architectural opening covering assembly. This makes the arrangement particularly advantageous when considering mounting the assembly to a window pane, rather than its surrounding frame.

The cord arrangement allows good mounting of movable end rails without requiring side rails of significant width. Hence, in a width direction, only a small amount of the available window area is lost. Similarly, the roller arrangement allows a small end rail to be provided, irrespective of whether that end rail is itself movable or not. Hence, once again, the amount of window area lost is relatively small.

To affix the assembly to a window pane, it is proposed to use a two-layer fastening material, such as a hook-and-loop fastener as is commonly known as Velcro™.

Referring to FIG. 1, one of the two layers of the two-layer fastener is adhered to at least portions of the back faces of the side rails 4, 6. In other words, they are attached to the faces of the side rails 4, 6 closest to the window pane and facing the window pane. The other layer of the two-layer fastener is adhered to at least corresponding sections of the window pane. For mounting the assembly, it is then merely a matter of offering the side rails 4, 6 up to the appropriate portions of the window pane and pressing them in place.

In the embodiment of FIG. 1, the fixed head rail 8 can also be attached to the window pane using the two-layer fastener material.

FIGS. 8 and 9 illustrate installation of the embodiment of FIG. 2 onto a window pane on which one layer of the two-layer material has already been adhered to the side edges of a window pane.

FIG. 10 illustrates how the second embodiment of the invention can be held in one or preferably two packing clamps 301, 303 for supporting lower and upper movable end rails 110,120 and left and right side rails 104, 106. This is convenient for transporting, packaging and as already illustrated in FIGS. 8 and 9 and further explained in relation to FIGS. 18-22 for installation of the blind to a window.

In the illustrated embodiment, as more clearly illustrated in FIGS. 11(*a*) and (*b*), each packing clamp 301, 303 includes cradles 305,307, for respective side left and right rails 104, 106. Similarly, it includes brackets 309, 311 for receiving respective movable end rails 110, 120.

Thus, as illustrated in FIG. 10, each side rail 104, 106 is supported by a pair of parallel cradles 305, 307 each of the pair of cradles 305, 307 being formed on a respective one of the two packing clamps 301, 303. Similarly, each movable end rail 110, 120 is supported by a pair of parallel brackets 309, 311 with each one of the pair being on a respective one of the two packing clamps 301, 303.

As illustrated, the brackets 309,311 of a packing clamp 301 are positioned side by side on a lower portion of the packing clamp 301 and the cradles 305, 307 are positioned side by side on an upper portion of the packing clamp 301. As a result, the side rails 104, 106 and movable end rails 110, 120 are all supported in a parallel orientation.

Preferably, the brackets 309, 311 have an inner surface which closely follows the circumferential contour of the outer housings 114, 126 of the movable end rails 110, 120 and snap-grip the movable end rails 120, 126. Similarly, the cradles 305, 307 can be formed merely to receive portions of the side rails 104, 106 or can be formed so as to grip the side rails 104, 106 in some manner.

As illustrated particularly in FIGS. 11(*a*) and (*b*), the movable end rails 110, 120 and side rails 104, 106, when supported by the packing clamps 301, 303, can be provided within a packing tube 313. This provides a very convenient and neat way of transporting, storing and/or selling a blind before installation.

FIG. 12 illustrates an alternative arrangement with a tube 315 of rectangular rather than circular cross-section.

As can be clearly seen in FIGS. 10 and 11(*a*), the first and second tension cords 122 and 124 for tensioning the lower movable rail 110 and the third and fourth tension cords 138 and 140 for tensioning the upper movable rail 120 are already present and connected to the blind so as to form a ready to install blind assembly. The cords 122, 124, 138 and 140 can be seen projecting the movable rails 110, 120 and from the left and right side rails 104, 106. In the clamped position the left and right side rails 104, 106 are parallel to the upper and lower movable rails 110, 120. However the rails are laid in reverse orientation to each other, top end cap 130*a* of left rail 104 is next to bottom end cap 132*b* of right rail 106. Likewise the lower end cap 130*b* of the left side rail 104 is next to the upper end cap 132*a* of the right rail 106. If no end caps are use the top end 104*a* of the left rail is next to the lower end of the right rail 106. This orientation is convenient for the tension cords, which are already routed through the movable rails and attached to the side rails. If another orientation would be preferred (i.e. the top ends of both rails adjacent to each other), the tension cords would need to be extra long.

So in FIG. 10 projecting form through opening 128*a* of lower movable rails 110 are first and second tension cords 122 and 124 seen in a loose loop. As described above, first tension cord 122 is routed from top end cap 130*a*, where it is attached to spring 134, through the rail 110 to through opening 128*b* and down to the lower end cap 132*b* of the right rail 106, where it is attached to first adjuster block 146. In the arrangement of FIG. 10, the routing is the same, but only small portions of the cords are visible. From through opening 128*a* in left housing end 114*a*, project cord portions of the first and second tension cords 122 and 124. These portions are shown in a loop, of which the loop of first cord 122 ends at top end cap 130*a* of the left rail 104, and the portion of the second tension cord 124 is directed towards the lower end cap 130*b* of the left side rail, but remains largely invisible because it is covered by the left rail 104 and passes underneath it to its opposite end cap.

Visible as projecting from left through opening 129*a* of the left housing end 126*a* of the upper movable rail 120 are portions of the third and fourth tension cords 138 and 140. Like the second tension cord 124, the fourth tension cord 140 passes along the left side rail 104 and remains largely invisible because it is covered by the left rail 104 and passes underneath it to its lower end cap 130*b*. Since both second tension cord 124 and fourth tension cord 140 have an and portion at lower end cap 130*b* of the left rail 104, they both pass underneath this rail in the packed configuration.

The visible portion of the third tension cord 138 loops from through opening 129*a* to the top end cap 130*a* of the left rail 104.

Other portions of the first and third tension cords 122 and 138 are visible adjacent the bottom end cap 132*b* of the right rail 106. These stem from the right through opening 128*b* of the lower movable rail 110 and the right through hole 129*b* of the upper movable rail 120 respectively.

Not visible in FIG. 10 are the portions of the second and fourth tension cords 124 and 140 which end at the top end cap 132*a* of the right rail 106. (In a different perspective these could be shown too).

FIG. 11(*a*) is a front view of the same situation. Here again is illustrated shown how the visible portion of the first tension cord 122 projects from through opening 128*a* from lower movable rail 110 to the top end cap 130*a* of the left rail 104 and the third tension cord 138 projects from the left through opening 129*a* of the upper movable rail 120 to the top end cap 130*a* of the left rail 104. Opposite portions of these first and third tension cords 122 and 138 are visible adjacent the bottom end cap 132*b* of the right rail 106.

Also clearly visible in FIG. 11(*a*) is how the second and fourth tension cords 124, 140 project respectively from the left through openings 128*a*, 129*a* and then disappear underneath the left rail 104 in the cradle 305.

In FIG. 11(*b*) the same arrangement as that of FIG. 10 is shown, sticking out from a package tube. Similarly FIG. 12 is the same with a square packing tube. For the sake of clarity, cords 122, 124, 138 and 140 are not illustrated in FIGS. 11(*b*) and 12, but it will be appreciated that these cords 122, 124, 138 and 140 will extend from the through holes 128*a*, 129*a* and are routed in the same manner as the cords illustrated in FIGS. 10 and 11(*a*).

Starting from the unpacked state of FIG. 10, a user can lift the side rails 104, 106 off the cradles 305, 307 and reorientate those side rails 104, 106 to their installation orientation, namely perpendicular to the movable end rails 10 as illustrated in FIG. 13.

As described before the side rails in the cradles lie counter-oriented to each other with the top end cap of one rail next to the bottom end cap of the other. After lifting the left side rail 104 from cradles 305 of the clamps 301 and 303, the left rail 104 is rotated so that its bottom end cap 130*b* points down. Likewise the right rail 106 is rotated so that is bottom end cap 132*b* points down.

The result is shown in FIG. 13.

In the arrangement of FIG. 13 the left and right side rail 104 and 106 are oriented perpendicular to the movable end rails 110 and 120. As is illustrated the excess lengths of the four tension cords 122, 124, 138 and 140 is not yet shortened to the preferred tensioned state. In a somewhat exaggerated manner the looped and too long tension cords are shown.

The cords are shown in their preferred routing, which is described above in relation to FIG. 3.

To take up the excess length of the first tension cord 122 the above described first adjuster blocks 146 is in lower portion of right rail 106 adjacent right lower end cap 132*b*, the second adjuster block 150 for the second tension cord 124 is in the lower portion of left rail 104 adjacent left lower end cap 130*b*. The third adjuster block 180 is slidably held in the upper portions of the left side rails 104, adjacent the left upper end cap 130*a* and fourth adjuster 184 for the fourth tension cord is in the upper portion of the right rail 106 adjacent the right upper end cap 132*a*. Also similar to the previous described stopper blocks for the first and second adjusters, there are third and fourth stopper blocks 182 and 186 for cooperation in the same side rails as the respectively the third and fourth adjuster blocks.

In left rail 104 in FIG. 14 the second and third adjuster 150, 180 and second and third stopper blocks 152, 182 are shown for the second and third tension cords 124, 138.

To take up the excess lengths of first cord 122, the adjuster block 150 is slid along the lengths of the side rail 104 until it abuts the stopper block 152 and then tightened in place in the manner described with reference to FIGS. 3(*b*) and (*c*).

The difficulty with tensioning any of the cords is that the adjuster block 146, 150, 180, 184 must be pulled towards the stopper block 148, 152, 182 and 186 against the tension of the springs 134, 136, 144, and 142 at the other ends of the respective cords 122, 124, 138, 140.

Also, the adjuster blocks are located within the channels of the side rails 104, 106 and are relatively inaccessible.

In order to facilitate manipulating the adjuster blocks and specifically moving the adjuster blocks against the spring tension to abut against the stopper blocks and holding them there when fastening them in position, an adjuster cord may be provided for each adjuster stopper block combination of the assembly.

One such adjuster cords 180 is illustrated in FIG. 14(*a*), for the second adjuster and stopper block combination 150, 152 for tensioning the second cord 124.

It is sufficient to provide an adjuster cord which is in some way fixed to the adjuster block 150 and which a user can take hold of and pull so as to pull the adjuster block 150 towards the stopper block 152. In this respect, a loop in the cord, such as loop 180*a* as illustrated, may be provided on the end of the adjuster cord 180. By holding this loop and pulling towards the stopper block, the adjuster is pulled up to the stopper block. However, in the preferred embodiment, the adjuster cord 180 extends from an end face of the adjuster block 150 facing an opposing end face of the stopper block 152. There is then provided a through hole in the stopper block 152 which starts at the end face of the stopper block facing the adjuster block 150 and exits facing out of the channel of the side rail. In this way, when a user pulls upon the loop 180*a* of the adjuster cord 180, the adjuster block 150 is pulled towards the stopper block 152 until the two respective end faces meet. It is then a relatively easy matter for the user to hold the adjuster block 150 to its correct position against the spring 136 at the other end of the second tension cord 124 before tightening the adjuster block 150 in place using the threaded member 154 and driver D. After the adjuster block 150 is fixed in place the adjuster cord 180 can be cut and removed from the blind assembly.

FIG. 14(*a*) illustrates an advantageous arrangement in which the adjuster cord 180 actually passes through a through hole in the adjuster block 150 similar to the through hole of the stopper block 152 having an opening at one end facing the stopper block 152 and an opening at the other end facing out of the channel of the side rail 104. As illustrated, the adjuster cord 180 is provided with two loops 180*a* and 180*b* and a knot 180*c*, at the join of each of the loops 180*a* and 180*b* which will not pass through the through hole in the adjuster or stopper block. Hence, when the user pulls upon the loop 180*a* of the adjuster cord 180, the knot 180*c* abuts the adjuster block 150 and the adjuster block 150 is pulled towards the stopper block 152.

FIG. 14(*b*) illustrates an adjuster block, a stopper block an adjuster cord 180 before installation in one of the side rails 4, 6, 104, 106. For any of the adjuster block and stopper block combinations for the blind assembly the combination of such a pair with an adjuster cord is identical.

With all the cords tensioned and the adjuster blocks in place, the user can then position the annular members 58, 158 of the ends of the movable end rails 110, 120 into the channel sections of the side rails 104 and 106.

The user thus arrives at an arrangement as illustrated in FIG. 15.

It will be noted in both FIGS. 13 and 15, when compared with FIG. 10, that the right-side (as illustrated) packing clamp 303 has been moved along the parallel lengths of the movable end rails 110, 120 towards the right side rail 106. It is possible now to do the same for the packing clamp 301 on the left-side (as illustrated) so as to arrive at the arrangement as illustrated in FIG. 16.

The packing clamps 301,303, when slid to their end positions so as to engage with the side rails 104, 106 as illustrated in FIG. 16, are intended to provide stability to the assembly as a whole.

This will be more clearly understood by reference to FIGS. 15-17 showing a package clamp 301 on the movable end rails 110, 120 and mounted on a cross-section of the side rail 104. The package clamp 301 includes a bracket 317 which extends in the longitudinal direction of the movable end rails 110, 120 so as to engage with the side rail 104. In particular, the bracket includes an upper section 319 shaped and dimensioned to fit with the upper or outer surface of the side rail 104 and a lower portion 321 shaped and dimensioned to fit inside the channel of the side rail 104. In particular, in the illustrated embodiment, the lower section in 321 includes a first part 321*a* which engages, from within the channel of the side rail 104, with the lower or inner surface of the outer wall of the side rail 104 forming the channel. The upper section 319 and first part 321*a* act together to define a space corresponding generally to the section of the outer wall of the side rail 104 preferably so as to snap fit with it and thereby engage the package clamp 301 with the side rail 104. The lower section 321 as illustrated also includes a second part 321*b* which engages with the inner wall of the side rail 104 forming the channel.

In this way, the package clamp provides a secure engagement between the movable end rails 110, 120 and the side rail 104. Similarly, the other package clamp 303 provides a secure engagement between the movable end rails 110, 120 and the side rails 106 such that the arrangement of FIG. 16 has stability and can be moved around ready for installation.

FIG. 17 illustrates a cross section of the side rail 104 with view through to the end cap 130*b*. The side rail 104 includes a base 190 for attachment to a window with a strip 198 of Velcro™ or other hook-loop-type connector as described above located at the bottom of the base 190. The side rail 104 itself is generally C-shaped with a lower channel section 192 for accommodating the tension spring 142 and an upper channel section 194 for accommodating the cords and a portion of the end cap of the movable roller. An outer wall 196 completes the channel.

A description of installing the assembly of FIG. 16 is now given.

As explained for the embodiments above, appropriate hook-loop strips or patches 198 can be provided on and/or adhered to a window, for instance on the glass. The window covering assembly can then be located onto the window as illustrated in FIGS. 18 and 15. With the assembly installed on the window, the package clamps 301, 303 are slid inwardly towards each other along the movable end rails 110, 120 so as to detach from their respective side rails 104,106. This is illustrated in FIG. 20. The package clamps 301, 303 may then be pulled off and detached from the movable end rails 110, 120 as illustrated in FIG. 21, leaving the window covering fully installed and enabling the movable end rails 110, 120 to be moved apart so as to cover the window as illustrated in FIG. 22.

As illustrated, the package clamps 301,303 are identical and the brackets 317 thereon can be used for engaging either side rail 104, 106 (which are also identical, depending on the orientation of the clamp on the movable rails 110, 120.

For the embodiment of the invention such as illustrated in FIG. 1 where a covering 2 is fixed relative to one peripheral edge by means of a fixed or immovable end rail 8 and then includes a moveable end rail 10 for drawing the covering across the architectural opening, it is similarly possible to provide packing clamps 401, 403 and provide the packed assembly in a packing tube 415. This is illustrated in FIGS. 23 and 24(*a*) and (*b*).

As illustrated, a pair of packing clamps 401, 403 are provided, each having a cradle 405, 407 for each of the respective side rails 4, 6. However, unlike the embodiment described above, the packing clamps 401, 403 each include only one bracket 409, because only one moveable end rail 10 is required to be supported. In comparison to the packing clamps 301, 303 described above, the packing clamps 401, 403 of this embodiment also include a portion 423 for receiving and supporting the fixed end rail 8.

The illustrated packing clamps 401, 403 are identical to each other and include both inwardly and outwardly facing brackets 417 such that the inwardly facing brackets 317 are redundant in use.

It should be appreciated that a packing clamp could be designed so as to cover either an arrangement with two moveable end rails or an arrangement with one moveable end rail and one fixed end rail. Features not required for a particular use will merely be redundant during that use.

As described above, this embodiment of the blind with a single movable rail 10 and a fixed rail 8 is also provided with a pair of tension cords 22, 24. The cord routing which is described above is repeated here for clarity. First or left tension cord 22 is attached to a top end cap 30*a* of left side rail 4, by means of a compression spring 34 and extends downwardly along left side rail 4 to the moveable rail 10, through the through opening 28*a* in left housing end 14*a* and along housing 14 to the right through opening 28*b* of right housing end 14*b*, the cord then continues downward to lower end cap 32*b* at right lower end 6*b* of the right side rail 6, where it is attached. In the preferred embodiment it is attached to a first adjuster block 46 for tensioning. Second or right tension cord 24 is attached to a top end cap 32*a* of the right side rail 6, by means of a compression spring 36 and extends downwardly along the right side rail 6 to the moveable rail 10, through the through opening 28*b* of the right housing end 14*b* and along the housing 14 to left through opening 28*a* of the left housing end 14*a* and down to lower left end cap 30*b* left side rail 4.

As can be clearly seen in FIGS. 23, 24(*a*), (*b*), 25 and 26, and in accordance with the invention, the first and second tension cords 22 and 24 for tensioning the movable rail 10 are already present and connected to the blind so as to form a ready to install blind assembly. The cords 22, 24 can be seen projecting the movable rail 10 and from the left and right side rails 4, 6. In the clamped position (best shown in FIG. 23) the left and right side rails 4, 6 are parallel to the fixed and movable rails 8, 10. However the rails are laid in reverse orientation to each other, top end cap 30*a* of left rail 4 is next to bottom end cap 32*b* of right rail 6. Likewise the lower end cap 30*b* of the left side rail 4 is next to the upper end cap 32*a* of the right rail 6. If no end caps are used the top end 4*a* of the left rail 4 is next to the lower end 6*b* of the right rail 6. This orientation is convenient for the tension cords, which are already present, routed through the movable rail and attached to the side rails. If another orientation would be preferred (i.e. the top ends of both rails adjacent to each other), the tension cords would need to be extra long.

In FIG. 23 certain portions of these cords are visible, projecting form through opening 28*a* of the movable rail 10 are first and second tension cords 22 and 24 seen in a loose loop. The loop of first cord 22 ends at top end cap 30*a* of the left rail 104, and the portion of the second tension cord 24 is directed towards the lower end cap 30*b* of the left side rail 4, but remains largely invisible because it is covered by the left rail 4 and passes underneath it to its opposite end cap.

This feature, of cord 24 lead underneath the left rail 4 in clamped configuration, is best visible in FIG. 24(*a*).

Figure 25:
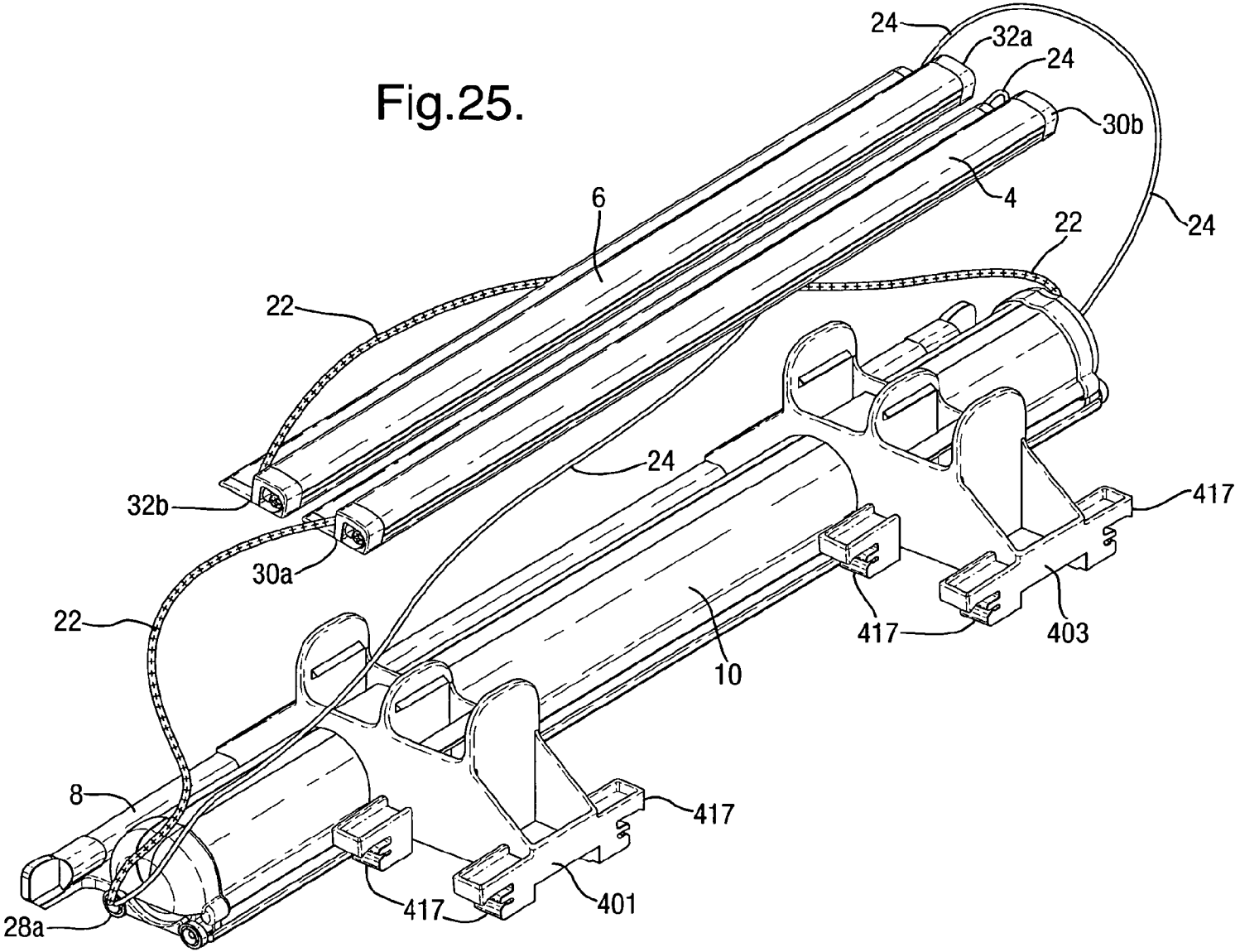

Having removed the assembly from the packing tube 415, the side rails 4, 6 may be lifted off their respective cradles 405, 407 as illustrated in FIG. 25. Here the cord routing of first and second tension cords 22, 24 can already be recognized.

The side rails 4, 6 are then moved and rotated to their positions at either respective end of the clipped-together moveable end rail 10 and fixed end rail 8.

Figure 26:
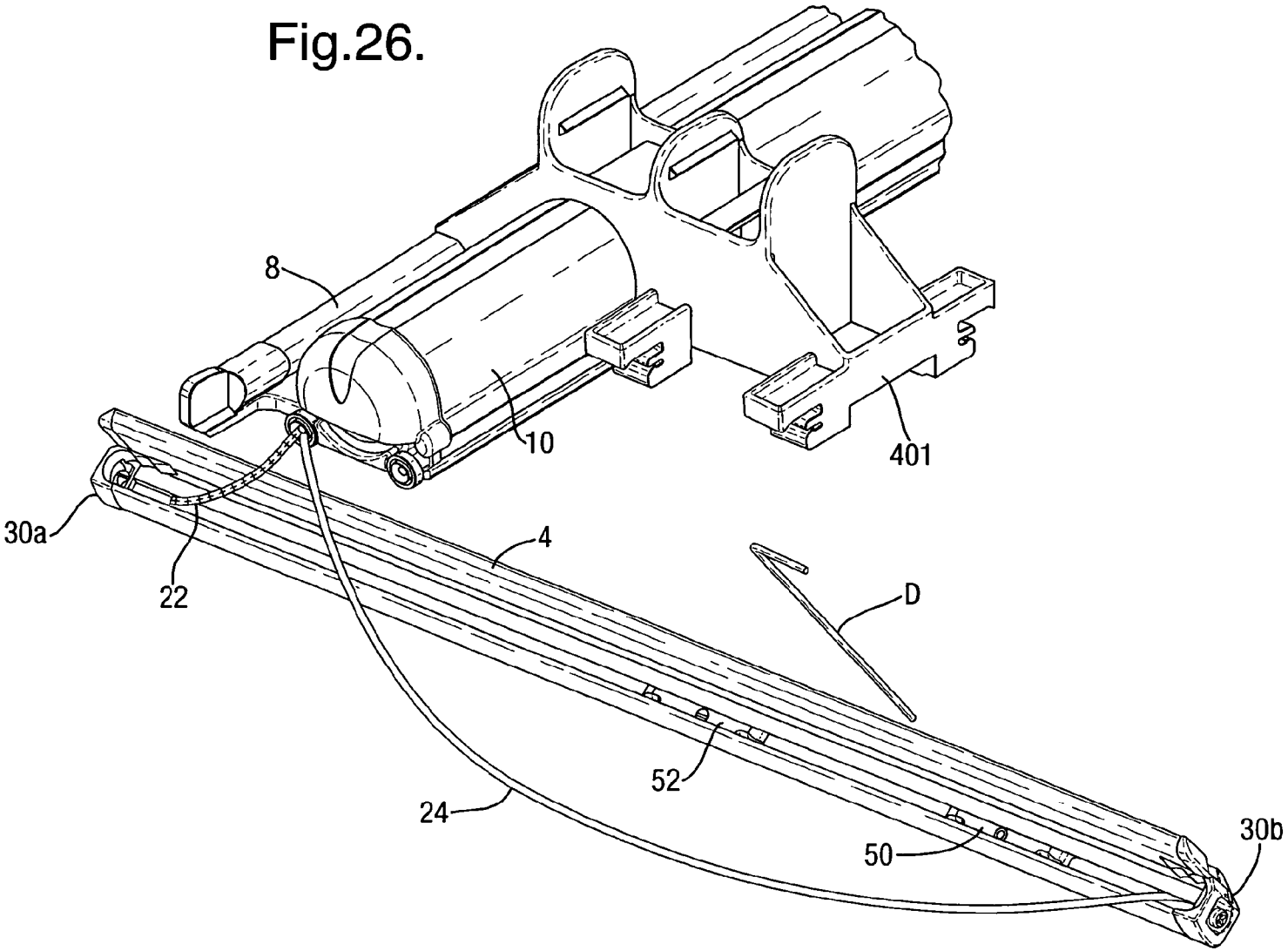

In this embodiment, of course, since there is only one moveable end rail 10, only two guide cords 22, 24 are required. FIG. 26, like FIG. 13 above, shows the use of an adjuster block 50 which slides along the length of a side rail (side rail 4 as illustrated) so as to abut a stopper block 52 and, hence, tighten the guide cord 24. This process will be directly equivalent to that described above with reference to FIG. 13 and, similarly, an adjuster cord such as described with reference to FIGS. 14(*a*) and (*b*) could similarly be provided.

With the tension cords adjusted appropriately, the packing clamps 401, 403 can then be moved along the parallel length of the moveable end rail 10 and fixed end rail 8 so as to engage with respective side rails 4 and 6 with bracket 417. This results in a stable assembly as illustrated in FIG. 27 and equivalent to FIG. 16 discussed above.

FIG. 28 illustrates, in the same manner as described above with reference to FIG. 18, that the secure assembly can be fixed to a window, for instance by means of appropriate hook-loop strips or patches 198. The package clamps 401, 403 can then be slid inwardly so as to disengage from their respective side rails 4, 6 and then pulled away from the fixed end rail 8 and moveable end rail 10 so as to leave the window covering ready for use.

As mentioned above, arrangements are possible using other types of covering, such as pleated coverings or Venetian blinds. FIGS. 29 and 30 illustrate an arrangement having a cover 202 formed from a plurality of slats forming a Venetian blind. Side rails 204, 206 and movable end rails 210, 220 are provided in the same manner as described above and with a similar guide cord structure of first and second tension cords 222, 224 for tensioning the lower movable rail 210 and third and fourth tension cords 238, 240 for tensioning the upper movable rail 220. It is possible similarly to provide package clamps: for supporting the movable guide rails 210, 220 and side rails 204, 206 in a manner similar to that described with reference to FIG. 10. Indeed, such an arrangement could also be provided in a packaging tube similar to that also illustrated in FIG. 11 or 12.

This invention is, of course, not limited to the exact details of the above-described embodiments which may be modified without departing from the scope of the claims or sacrificing all of its advantages. In this regard, the terms in the foregoing description and the following claims, such as "right", "left", "front", "rear", "vertically", "horizontally", "longitudinally", "upper", "lower", "top" and "bottom", have been used only as relative terms to describe the relationships of the various elements of the movable rails, fixed rails tension cords, end caps, adjuster blocks and the like of the blinds as described and shown in the figures.

For example, instead of using the described pairs of tension cords 22, 24, 122, 124, 222, 224, 138, 140, 238, 240 for each movable rail 10, 110, 120, 210, 220 with a dedicated tension spring for each cord, it is possible to use a single cord for each movable rail. A single tension cord arrangement for a movable rail is less stable than two separate cords, but it is easier to install. The negative effect of possible skewing of the movable rail when it is manipulated by a user can be reduced by placing a handle in the middle of the movable rail. The user will tend to use the handle, and by operating the movable rail from its centre, the risk of skewing is reduced. Such a single cord would include a loop. As an example the cord routing of such a single looped tension cord "SL" is described for tensioning the movable rail of the first embodiment of FIG. 1. Cord SL would be attached to left top end 4*a* or left top end cap 30*a* of a left side rail 4 and routed down along the side rail 4 to the left end housing 14*a* of the movable rail 10, through the movable rail 10 to the right end housing 14*b* of the movable rail 10, down to the right lower end 6*b* of the right rail 6 (or the right lower end cap 32*b* therefrom), than towards the left lower end 4*b* of the left rail 4 (or the left lower end cap 30*b* therefrom), upwards along the left side rail 4 and to the left end housing 14*a* of the movable rail 10, through the movable rail to the right end housing 14*b* therefrom and up through the right rail 6 to the upper right end 6*a* therefrom or to the right top end cap 32*a*. The tension spring can be provided in either the left top end 30*a* of the left side rail or the right top end 32*a* of the right end rail, the slider block for adjusting the excess length of the tension cord SL will be placed in the side rail were the other end of cord SL ends. Other such "single cord arrangements" where each movable rail is tensioned by a single cord are also possible.

Also for example, instead of mounting the blind directly to a window by means of Velcro strips, as described above. Other ways of mounting the blind are equally possible. By brackets to a window frame, by so-called bead brackets that are inserted between the glass of a window and a glass-bead.

FIG. 1 actually shows brackets adjacent fixed head rail 8, and left and right side rails, suggesting a conventional mounting of the blind assembly.

| Number | Description |
|---|---|
| 2, 102, 202 | blind |
| 2a | upper portion |
| 2b | lower portion |
| 4, 104, 204 | left side rail |
| 4a, 104a | upper end left rail |
| 4b, 104b | lower end left rail |
| 6, 106, 206 | right side rail |
| 6a, 106a | upper end, right rail |
| 6b, 106b | lower end right side rail |
| 8 | fixed end rail |
| 10, 110, 210 | first or lower movable rail |
| 12, 112 | first roller |
| 14, 114 | housing |
| 14a, 114a | left housing end |
| 14b, 114b | right housing end |
| 16 | spring bias arrangement |
| Xx, 118 | second roller |
| XX, 120, 220 | second (upper) movable rail |
| 22, 122 (yellow), 222 | first tension cord |
| 24, 124 (purple), 224 | second tension cord |
| XX, 126 | second housing |
| 126a | second housing left end |

-continued

| Number | Description |
|---|---|
| 126b | second housing right end |
| 28, 128 | through holes, through housing ends of housing 14, 114 |
| 28a, 128a | left through opening |
| 28b, 128b | right through opening |
| 129a, | left through opening in second housing 126 |
| 129b | right through opening in second housing 126 |
| 30a, 130a | top end cap left rail |
| 30b, 130b | bottom end cap left rail |
| 32a, 132a | top end cap right rail |
| 32b, 132b | bottom end cap right rail. |
| 34, 134 | first compression spring, top end, left rail. for first tension cord 22, 122, for first (lower) movable rail 10, 110 |
| 36, 136 | second spring, top end right rail, for second tension cord 24, 124, for first (lower) movable rail 10, 110 |
| XX, 138 (blue), | third tension cord for second upper movable rail 120 |
| XX, 140 (green) | fourth tension cord for second upper movable rail 120 |
| XX, 142 | third spring for third cord 138 (blue) |
| XX, 144 | Fourth spring, for fourth cord 140 (green) |
| XX, 146 | first adjuster block for first tension cord 122, in lower portion of right rail 106 |
| XX, 148 | first stopper block for first tension cord 122 |
| XX, 150 | second tension block, for second tension cord, 124 in lower portion of left rail 104. |
| XX, 152 | second stopper block, for second tension cord 124, in lower portion of left rail 104. |
| xx, 154 | threaded member for second adjuster block 150 |
| 56, 156 | shaft on housing ends |
| 58, 158 | annular members on shafts on housing ends fitting into side rails 4, 6, 104, 106 |
| 60 | finishing cap for housing 14 of movable rail 10 |
| 62 | coil spring for spring bias arrangement 16 |
| 64 | first end of spring 62 |
| 66 | drive spring end of spring 62 |
| 68 | cut-tout in roller 12 |
| 70 | opposite end of spring 62 |
| 72 | floating spring end |
| 74 | slotted through hole in housing end 14b, concentric to roller 12 |
| 76 | elongate member to fit into slotted hole 74 |
| 78 | slotted through hole, in floating spring end |
| XX 180 | third adjuster |
| XX, 182 | third stopper block |
| XX, 184 | fourth adjuster |
| XX, 186 | fourth stopper |
| XX, 188 | adjuster cord |
| XX, 190 | base of side rail 4, 104 |
| 192 | lower channel section |
| 194 | upper channel section |
| 196 | outer wall |
| 198 | strip of hook or loop like Velcro |
| XX, 301, 401 | packing clamps, FIG. 10; FIG. 23 |

-continued

| Number | Description |
|---|---|
| 303 403 | FIG. 10; FIG. 23 |
| 305, 405, | first cradle for left side rail 104 |
| 307, 407 | second cradle for right side rail 106 |
| 309 409 | first bracket for first movable rail 110 |
| 311 | second bracket for second movable rail 120 |
| 313 | packing tube |
| 315 415 | rectangular packing tube |
| 317, 417 | bracket on clamp 301 |
| 319, 417 | upper section bracket 317 |
| 321, 421 | lower portion bracket 317 |
| 321a, 421a | first part of lower section 321 of bracket 317 |
| 321b, 421b | second part of lower section 321 of bracket 317 |

The invention claimed is:

1. An architectural opening covering assembly that is reconfigurable from a collapsed position to an extended position, comprising:

two side rails configured to be mounted in parallel on opposite respective sides of an architectural opening;

at least one moveable end rail operably connected to the two side rails and in the extended position the at least one movable rail has a first orientation and extends substantially perpendicularly between the two side rails and is movable along the two side rails, and in the collapsed position the at least one movable end rail has a second non-perpendicular orientation with respect to the two side rails;

a cord arrangement extends along the two side rails and the movable end rail and operably connects the at least one movable rail to at least one of the two side rails; and a first spring for securing the cord arrangement to one of the two side rails and a second spring for securing the cord arrangement to the other of the two side rails; wherein the first spring is received around a first end of the cord arrangement and the second spring is received around a second end of the cord arrangement;

in the extended position, the cord arrangement secures the movable end rail at substantially any position along the two side rails, and in the collapsed position, the cord arrangement secures each end of the movable end rail to a respective side rail such that the two side rails and movable end rail remain secured together.

2. An assembly according to claim 1, wherein in the collapsed position the movable end rail is substantially parallel to the two side rails.

3. An assembly according to claim 2 further comprising:

at least one packing clamp including a first cradle configured to hold one of the two side rails and a second cradle configured to to hold the other of the two side rails, and at least one bracket configured to receive the at least one moveable end rail; wherein the packing clamps secures the two side rails and the at least one moveable end rail adjacent and parallel to one another in the collapsed position.

4. An assembly according to claim 3 further comprising two packing clamps; wherein in the expanded position the two packing clamps are slidable along the at least one moveable end rail and engageable with a respective one of the two side rails so as to substantially rigidly secure the at least one moveable end rail between the two side rails.

5. An assembly according to claim 4 wherein: the at least one bracket of the at least one packing clamp is configured to spring-clip around part of the periphery of the at least one moveable end rail such that, with the two side rails mounted on opposite respective sides of an architectural opening, the at least one packing clamp can be disengaged from the moveable end rail.

6. An assembly according to claim 1 wherein the cord arrangement includes a cord having end portions extending along each of the two side rails and an intermediate portion extending through the moveable end rail.

7. An assembly according to claim 6 wherein the first spring and the second spring limit an amount that the cord can be pulled away from the two side rails and the first spring and the second spring are at least partially compressed as the covering transitions from the extended position to the collapsed position.

8. An assembly according to claim 7 further including an adjust mechanism connected to one of the two side rails and an end of the cord for adjustably securing the end of the cord to one of the two side rails, the adjust mechanism being selectively moveable between a first state in which an excess cord length is provided between the moveable end rail and the two side rails and a second state in which the excess length is taken up.

9. An assembly according to claim 8 wherein: the adjust mechanism includes an adjuster block slidably connected to one of the two side rails and operably connected to the end of the cord so that the cord extends from the adjuster, through a position at least proximate an end of the one of the two side rails and to the moveable end rail; and wherein in the first state the adjuster block is substantially proximate the end of the one of the two side rails and in the second state the adjuster is positioned at a distance away from the end of the one of the two side rails.

10. An assembly according to claim 9 further including means for securing the adjuster in at least the first state.

11. An assembly according to claim 10 further including a stopper received within one of the one of the two side rails and positioned to stop a movement of the adjuster block along the length of the one of the two side rails at a position away from the end of the one of the two side rails at which the adjust mechanism is in the second state.

12. An assembly according to claim 11 further including a second cord and a second adjust mechanism for adjustably securing an end of the second cord to the other of the two side rails.

13. An assembly according to claim 1 wherein the side rails include respective guide tracks.

14. An assembly according to claim 1 wherein the moveable end rail has a constant cross-section along its length and end members on its opposite longitudinal ends.

15. An assembly according to claim 1 further including a packing tube, in which are the two side rails and the moveable end rail orientated parallel to one another.

16. An assembly according to claim 1 further including a flexible covering member extendable from the moveable end rail.

17. An assembly according to claim 16 wherein the covering member is a Venetian blind or a pleated shade.

18. An assembly according to claim 16 wherein the moveable end rail houses a retraction mechanism.

19. An assembly according to claim 18 wherein the moveable end rail includes a roller for winding the flexible covering member.

20. An assembly according to claim 19 wherein the roller is spring biased.

21. An assembly according to claim 20 wherein the roller further includes a roller member; and a biasing spring at least partially received around the roller member, wherein the biasing spring has one of its ends slidably, but non-rotatably, connected on a portion of the roller member.

22. An assembly according to claim 19 wherein a first edge of the flexible covering member is attached to the roller.

23. An assembly according to claim 22 wherein an opposite second edge of the flexible covering member is attached to a fixed end rail affixed to corresponding ends of the two side rails.

24. An assembly according to claim 23 wherein an opposite second edge of the flexible covering member is attached to a second moveable end rail extending perpendicularly between the two side rails so as to be moveable along the side rails.

25. An assembly according to claim 24 wherein the opposite second edge of the flexible covering member is attached to a further roller.

* * * * *